US011760458B2

(12) United States Patent
Hasegawa et al.

(10) Patent No.: US 11,760,458 B2
(45) Date of Patent: Sep. 19, 2023

(54) OUTBOARD MOTOR ENGINE COVER AND OUTBOARD MOTOR

(71) Applicant: YAMAHA HATSUDOKI KABUSHIKI KAISHA, Iwata (JP)

(72) Inventors: Hiroyuki Hasegawa, Shizuoka (JP); Takahiro Matsui, Shizuoka (JP); Ryosuke Hata, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/520,780

(22) Filed: Nov. 8, 2021

(65) Prior Publication Data

US 2022/0204148 A1 Jun. 30, 2022

(30) Foreign Application Priority Data

Dec. 28, 2020 (JP) ..... 2020-219305

(51) Int. Cl.

| | |
|---|---|
| ***B63H 20/32*** | (2006.01) |
| ***F02M 35/10*** | (2006.01) |
| ***F02B 61/04*** | (2006.01) |

(52) U.S. Cl.

CPC ..... *B63H 20/32* (2013.01); *F02B 61/045* (2013.01); *F02M 35/10006* (2013.01); *F02M 35/1015* (2013.01)

(58) Field of Classification Search

CPC . B63H 20/32; F02B 61/045; F02M 35/10006; F02M 35/1015; F02F 7/00; F02F 7/0021

See application file for complete search history.

(56) References Cited

U.S. PATENT DOCUMENTS

| | | | | |
|---|---|---|---|---|
| 4,723,927 | A * | 2/1988 | Walsh | F02B 61/045 D15/4 |
| 4,869,693 | A * | 9/1989 | Curtis | F02B 61/045 123/195 P |
| 11,046,409 | B2 * | 6/2021 | Wiegele | B63H 20/28 |
| 2007/0054569 | A1 | 3/2007 | Murai et al. | |
| 2018/0327067 | A1 * | 11/2018 | Hasegawa | F02B 61/045 |

FOREIGN PATENT DOCUMENTS

| | | | |
|---|---|---|---|
| JP | 2006-205849 | A | 8/2006 |
| JP | 2007-069823 | A | 3/2007 |
| JP | 2018-192840 | A | 12/2018 |

* cited by examiner

*Primary Examiner* — Grant Moubry

(74) *Attorney, Agent, or Firm* — KEATING AND BENNETT, LLP

(57) ABSTRACT

An outboard motor includes an engine to rotate a propeller and an engine cover that houses the engine. The engine cover includes two divided covers disposed above the engine and that directly face the engine. The two divided covers include two connections that are connected together and that overlap the engine in a plan view.

2 Claims, 13 Drawing Sheets

OUTBOARD MOTOR ENGINE COVER AND OUTBOARD MOTOR

CROSS REFERENCE TO RELATED APPLICATIONS

This application claims the benefit of priority to Japanese Patent Application No. 2020-219305 filed on Dec. 28, 2020. The entire contents of this application are hereby incorporated herein by reference.

BACKGROUND OF THE INVENTION

1. Field of the Invention

The present invention relates to an engine cover that is used for an outboard motor and that houses an engine, and relates to an outboard motor provided with the engine cover.

2. Description of the Related Art

An outboard motor provided with a cowling with which an engine is covered is disclosed by Japanese Patent Application Publication No. 2007-069823. An engine room in which the engine is disposed is formed by a top cowl and a bottom cowl of the cowling. FIG. 1 of Japanese Patent Application Publication No. 2007-069823 depicts the top cowl so as to be a single integrated member. FIG. 3 of Japanese Patent Application Publication No. 2007-069823 depicts the top cowl so as to directly face the engine.

Japanese Patent Application Publication No. 2018-192840 discloses an outboard motor provided with an engine cover with which an engine is covered. The engine cover is divided into a top portion and a bottom portion. The bottom portion is divided into a front bottom portion and a pair of side bottom portions. A boundary between the top portion and the front bottom portion is sealed by a seal structure. Other boundaries inside the engine cover are also sealed by the seal structure. FIG. 2 of Japanese Patent Application Publication No. 2018-192840 depicts the top portion so as to be a single integrated member and so as to directly face the engine.

The top cowl of Japanese Patent Application Publication No. 2007-069823 and the top portion of Japanese Patent Application Publication No. 2018-192840 are each a single integrated member that directly face the engine. Due to these large integrated members, restrictions will be imposed on their shapes or on their materials. In order to increase the degree of shape freedom, it is conceivable that the top cowl of Japanese Patent Application Publication No. 2007-069823 will be divided into parts, and yet, if the top cowl is not divided at appropriate positions, it is impossible to effectively reduce all parts obtained by dividing the top cowl, and it is impossible to lighten restrictions imposed on the shapes or the like. Likewise, when the top portion of Japanese Patent Application Publication No. 2018-192840 is divided into parts, it is impossible to lighten restrictions imposed on the shapes or the like if the top portion is not divided at appropriate positions.

SUMMARY OF THE INVENTION

In order to overcome the previously unrecognized and unsolved challenges described above, a preferred embodiment of the present invention provides an engine cover for an outboard motor that houses an engine, and the engine cover includes two divided covers disposed above the engine and that directly face the engine, and the two divided covers include two connections that are connected to each other and that overlap the engine in a plan view.

According to the above structural arrangement, a portion, which is located above the engine, of the engine cover is divided into two pieces. In other words, the two divided covers that directly face the engine are disposed at the engine cover. This makes it possible to increase the degree of freedom of the shape of the engine cover. Additionally, the two connections of the two divided covers are located above the engine, and overlap the engine in a plan view. Therefore, the two divided covers are divided at a location which overlaps the engine in a plan view. Therefore, it is possible to make a size difference between the two divided covers smaller, and is possible to make restrictions, such as a shape restriction, imposed on the engine cover smaller than when the two divided covers are divided only at a location which does not overlap the engine in a plan view.

According to other preferred embodiments of the present invention, at least one of the following features may be added to the engine cover.

An interval between the two connections is uniform at any location along the two connections.

According to the above structural arrangement, an interval between the two connections of the two divided covers is uniform at any location without changing depending on its location. If the interval between the two connections is not uniform, there is a possibility that another cover to be interposed between the two connections will be required. If the interval between the two connections is uniform, it is possible to connect the two divided covers together without such a cover interposed between the two connections.

The engine cover further includes an adhesive layer disposed between the two connections and by which the two connections are bonded together.

According to the above structural arrangement, the adhesive layer is interposed between the two connections. The adhesive layer is a thin film of a dried adhesive, for example. Each of the two connections is chemically or physically joined to the adhesive layer. Thus, the two connections are connected together through the adhesive layer. Additionally, the adhesive layer blocks a gap between the two connections. Therefore, it is possible to increase the sealability of the engine cover in addition to enabling the two connections to be connected together.

The two connections are bonded together with the adhesive layer at any location along the two connections in a plan view.

According to the above structural arrangement, the two connections are bonded together along a large range. More specifically, the adhesive layer interposed between the two connections is disposed at any location along the two connections in a plan view. Therefore, the range in which the adhesive comes into contact with the two connections is wide, and the area of the adhesive layer is large. This makes it possible to increase the adhesive strength of the two connections and the sealability of the engine cover.

The two divided covers include two housings that directly face the engine, and the two connections include two flanges that protrude outwardly from the two housings, and the two flanges are bonded together by the adhesive layer.

According to the above structural arrangement, the two housings and the two flanges are disposed at the two divided covers. The two housings directly face the engine, and the two flanges protrude outwardly from the two housings. It is possible to increase the rigidity of the two divided covers by disposing the two flanges turned back from the two housings. The two flanges included in the two connections are bonded together by the adhesive layer. In other words, it is possible to enlarge a range in which an adhesive comes into contact with the two connections by providing the two flanges, and it is possible to increase the adhesive strength of the two connections.

Each flange is disposed at any location along its respective connection.

According to the above structural arrangement, the flange is not disposed only at a specific location of the connection, but is disposed at any and all locations of the connection. This makes it possible to enlarge a range in which an adhesive comes into contact with the two connections, and makes it possible to increase the adhesive strength of the two connections. Therefore, it is possible to prevent the two divided covers from being separated from each other at the two connections. Additionally, the adhesive application range is enlarged, and the area of the adhesive layer is widened, and therefore it is possible to make the sealability of the engine cover even higher.

The engine cover further includes at least one bolt to fasten the two connections together.

According to the above structural arrangement, the two connections are fastened together by the bolt in addition to bonding the two connections together by an adhesive. This makes it possible to increase the strength of the two connections. Additionally, when the two connections are fastened together by the bolt, the two divided covers are fixed before the adhesive is dried. Therefore, the two divided covers are not required to be immobilized until the adhesive becomes dry, or are not required to be fixed by a jig until the adhesive becomes dry. Additionally, when the two connections are fastened together by the bolt, the two divided covers are fixed in an appropriate positional relationship, and therefore it is possible to prevent the two divided covers from being bonded together in a deviated state.

The two divided covers include two bands that define a cylindrical air intake ring through which air to be supplied to the engine passes, and the two bands are fitted to each other at both ends of the two bands, and the two connections include both ends of the two bands.

According to the above structural arrangement, the cylindrical air intake ring through which air to be supplied to the engine passes is disposed at the two divided covers. The air intake ring is divided into the two bands. Both ends of the two bands define a portion of the two connections. Therefore, the two divided covers are divided from each other at a location passing through the air intake ring. The air intake ring is ordinarily disposed at a center of the engine or at a position near the center in a plan view. Therefore, it is possible to reduce a size difference between the two divided covers by dividing the two divided covers at the location passing through the air intake ring.

An outer diameter of the air intake ring becomes larger as the air intake ring approaches or extends to a front end of the air intake ring.

According to the above structural arrangement, the diameter of the outer peripheral surface of the air intake ring stepwisely or continuously becomes larger as the air intake ring approaches or extends to the front end of the air intake ring. Therefore, it is difficult for water to enter the air intake ring from the front end of the air intake ring while flowing or splashing along the outer peripheral surface of the air intake ring. If the air intake ring is a single unitary member, there is a possibility that the air intake ring cannot have the above structure depending on the manufacturing method of or the material of the air intake ring. If the air intake ring is divided into the two bands, the air intake ring is able to be arranged in the above way.

An inner diameter of the air intake ring continuously becomes larger as the air intake ring approaches or extends to the front end of the air intake ring, and a maximum value of the inner diameter of the air intake ring is larger than a minimum value of the outer diameter of the air intake ring.

According to the above structural arrangement, the diameter of the inner peripheral surface of the air intake ring continuously becomes larger as the air intake ring approaches the front end of the air intake ring. Therefore, it is possible to reduce resistance of air drawn through an entrance defined by the front end of the air intake ring into the air intake ring. This makes it possible to reduce the pressure loss of the intake air, and makes it possible to improve the output of the engine. It is possible to weaken negative pressure inside the engine cover by reducing the pressure loss of the intake air in the air intake ring, and it is possible to reduce water entering into the engine cover from a joint of the engine cover. Additionally, the maximum value of the inner diameter of the air intake ring is larger than the minimum value of the outer diameter of the air intake ring, and therefore the outer diameter of the air intake ring stepwisely or continuously becomes larger as the air intake ring approaches the front end of the air intake ring. Therefore, it is difficult for water to enter into the air intake ring from the front end of the air intake ring while flowing or splashing along the outer peripheral surface of the air intake ring.

Each of the two connections includes a front end located in front of the engine, an upper end located above the engine, and a rear end located behind the engine.

According to the above structural arrangement, the two divided covers are divided not only above the engine but also in front of and behind the engine. The two connections extend from the front of the engine to the rear of the engine through a space above the engine. Therefore, the two divided covers are divided rightwardly and leftwardly. The engine cover ordinarily has a substantially lateral symmetrical shape. Therefore, it is possible to reduce a size difference between the two divided covers by dividing the two divided covers rightwardly and leftwardly.

The two divided covers are divided at a division line that defines a boundary between the two divided covers and a virtual plane extending from a front portion of the engine to a rear portion of the engine in a plan view, and the division line passes through a location at which a distance from a right end of the two divided covers to the division line and a distance from a left end of the two divided covers to the division line are equal or substantially equal to each other in a plan view.

According to the above structural arrangement, the two divided covers are divided with the division line defining a boundary between these covers. The division line halves or substantially halves the two divided covers rightwardly and leftwardly in a plan view. More specifically, the division line passes through a location at which a distance from a right end of the two divided covers to the division line is equal or substantially equal to a distance from a left end of the two divided covers to the division line in a plan view. This makes it possible to equalize or substantially equalize the two divided covers with each other in size.

At least a portion of an outline of the two divided covers in a plan view is located outside an outline of the engine in a plan view.

According to the above structural arrangement, at least a portion of the outline of the engine in a plan view overlaps the two divided covers in a plan view. Therefore, the two divided covers have a size in which at least a portion of the outline of the two divided covers in a plan view is located outside the outline of the engine in a plan view. This large-sized engine cover is divided, and therefore it is possible to reduce restrictions, such as a shape restriction, imposed on the engine cover.

The outline of the two divided covers in a plan view may surround the outline of the engine in a plan view over the whole circumference of the engine. In this case, any portion of the outline of the two divided covers in a plan view is located outside the outline of the engine in a plan view. This large-sized engine cover is divided, and therefore it is possible to reduce restrictions, such as a shape restriction, imposed on the engine cover.

The engine cover further includes an exterior panel disposed outside the two divided covers and that overlaps at least a portion of the two connections.

According to the above structural arrangement, the two connections are protected by the exterior panel. The exterior panel is disposed outside the two divided covers. When the two connections are seen from outside the two divided covers, the exterior panel overlaps at least a portion of the two connections, and at least a portion of the two connections is concealed by the exterior panel. Mist or spray collides with the exterior panel before reaching the two connections. Therefore, it is possible to reduce water that passes through a space between the two connections and then enters into the engine cover, and it is possible to increase the waterproofness of the engine cover. Additionally, when the two connections are concealed by the exterior panel, water pressure is not directly applied to the boundary between the two connections, and therefore it is possible to increase the robustness of the two connections.

Another preferred embodiment of the present invention provides an outboard motor that includes an engine to rotate a propeller and the engine cover described above to house the engine.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be hereinafter described in detail with reference to the accompanying drawings.

An outboard motor main body 4 in a basic posture will be hereinafter described. The basic posture is a posture in which a center line Lp of a propeller shaft 18 horizontally extends in a direction perpendicular to a center line Lt of a tilt shaft 7. A front-rear direction, an up-down direction, and a left-right direction are defined based on the outboard motor main body 4 being in the basic posture. The left-right direction corresponds to a width direction. The front-rear direction, the up-down direction, and the left-right direction of the outboard motor main body 4 correspond to the front-rear direction, the up-down direction, and the left-right direction of an engine cover 21, respectively. An "upper end" in the following description denotes a portion, which is positioned at the highest location, of an element. In other words, the "upper end" denotes an uppermost end. The same applies to a lower end, a front end, a rear end, a right end, a left end, an outer end, and an inner end.

Figure 1:
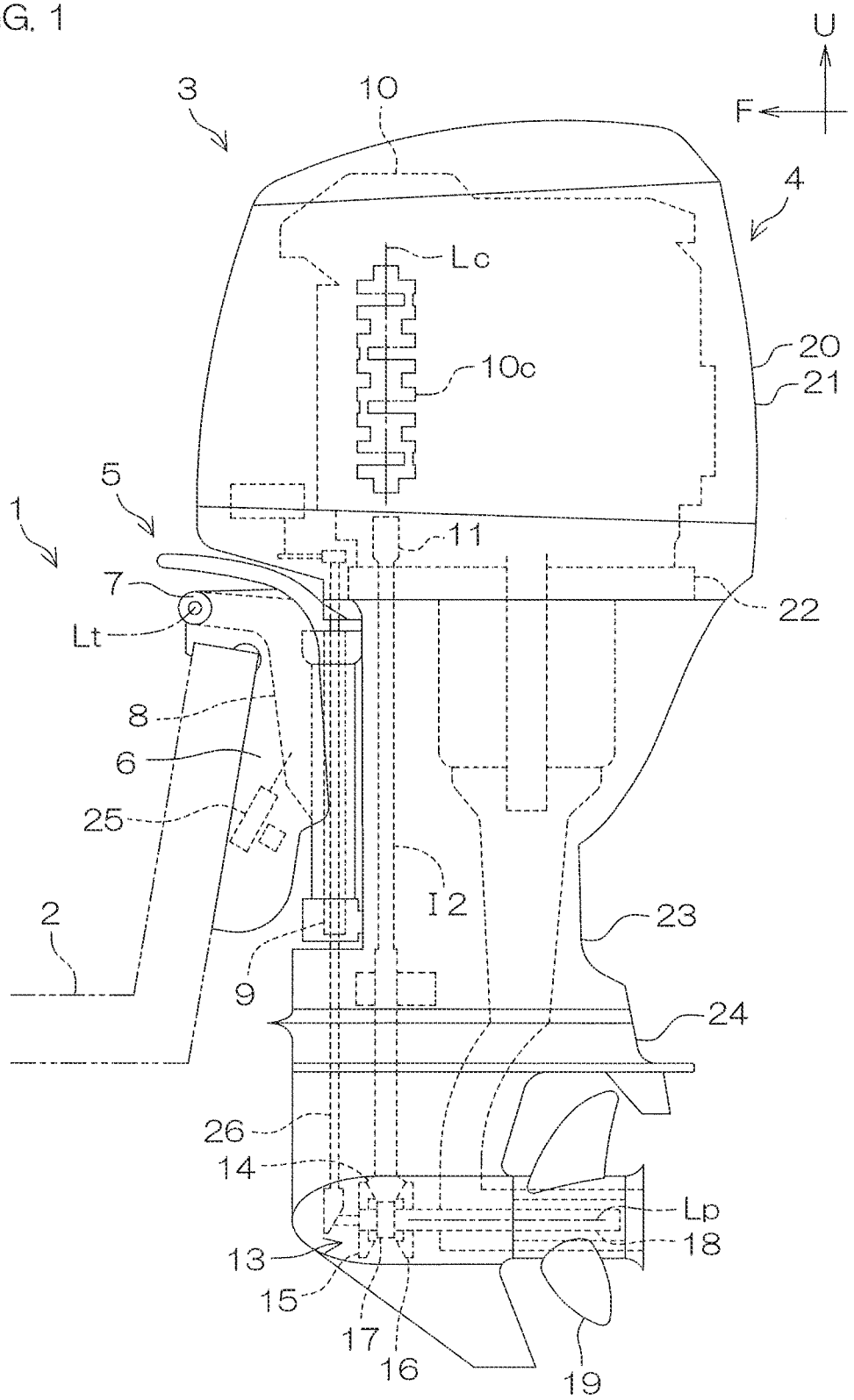
FIG. 1 is a left side view of an outboard motor according to a first preferred embodiment of the present invention.

FIG. 1 is a left side view of an outboard motor 3 according to a first preferred embodiment of the present invention. A vessel 1 includes a hull 2 that floats on a water surface and the outboard motor 3 that propels the hull 2. The outboard motor 3 includes the outboard motor main body 4 that generates a thrust and a suspension device 5 by which the outboard motor main body 4 is attached to a rear portion of the hull 2. The outboard motor 3 additionally includes a tilt device 25 that turns the outboard motor main body 4 upwardly and downwardly with respect to the hull 2.

The outboard motor main body 4 is disposed behind the hull 2. The suspension device 5 includes a clamp bracket 6 fixed to the hull 2, a swivel bracket 8 supported by the clamp bracket 6 through the tilt shaft 7 extending in the left-right direction, and a steering shaft 9 held by the swivel bracket 8 in a vertical posture. The outboard motor main body 4 is connected to an upper end portion and a lower end portion of the steering shaft 9.

The outboard motor main body 4 is turnable rightwardly and leftwardly around the steering shaft 9 with respect to the clamp bracket 6 together with the steering shaft 9.

Additionally, the outboard motor main body 4 is turnable upwardly and downwardly around the tilt shaft 7 with respect to the clamp bracket 6 together with the steering shaft 9 and together with the swivel bracket 8. Therefore, the outboard motor main body 4 is turnable rightwardly and leftwardly with respect to the hull 2, and is turnable upwardly and downwardly with respect to the hull 2.

The outboard motor main body 4 includes an engine 10 that rotates a propeller 19 and a drivetrain 11 that transmits the rotation of the engine 10 to the propeller 19. The outboard motor main body 4 additionally includes a casing 20 that houses the engine 10 and the drivetrain 11. The casing 20 includes an engine cover 21 that houses the engine 10, an exhaust guide 22 disposed below the engine 10, an upper case 23 disposed below the exhaust guide 22, and a lower case 24 disposed below the upper case 23. The engine cover 21 and the exhaust guide 22 are disposed at a higher position than the water surface.

The engine 10 includes a piston that reciprocates in response to the combustion of an air-fuel mixture that includes fuel and air, a cylinder that houses the piston, a crankshaft 10*c* that rotates in response to the reciprocation of the piston, and a connecting rod by which the crankshaft 10*c* and the piston are connected together. The cylinder includes a cylinder body that houses the piston and a cylinder head that defines, together with the piston and together with the cylinder body, a combustion chamber in which an air-fuel mixture burns. When a starter motor starts the engine 10, the crankshaft 10*c* continues rotating in a fixed rotation direction around a vertical rotational center Lc.

The drivetrain 11 includes a drive shaft 12 that extends in the up-down direction, a propeller shaft 18 that extends in the front-rear direction, and a forward-reverse switching gear 13 that transmits the rotation of the drive shaft 12 to the propeller shaft 18. The drive shaft 12 is disposed below the engine 10. The engine 10 is located on the exhaust guide 22. The drive shaft 12 is disposed inside the exhaust guide 22, the upper case 23, and the lower case 24. The forward-reverse switching gear 13 and the propeller shaft 18 are disposed inside the lower case 24. The propeller shaft 18 protrudes rearwardly from the lower case 24. The propeller 19 is attached to the propeller shaft 18 behind the lower case 24. The propeller 19 is disposed behind the lower case 24.

The forward-reverse switching gear 13 includes a pinion 14 that rotates together with the drive shaft 12, a front gear 15 that engages with the pinion 14, and a rear gear 16 that engages with the pinion 14. The forward-reverse switching gear 13 additionally includes a dog clutch 17 that is movable between a connection position for engagement with either the front gear 15 or the rear gear 16 and a disconnection position spaced apart from both the front gear 15 and the rear gear 16. The outboard motor 3 includes a shift device 26 that moves the dog clutch 17 between the connection position and the disconnection position.

The pinion 14, the front gear 15, and the rear gear 16 are each a bevel gear. The pinion 14 is coaxial with the drive shaft 12, and the front gear 15 and the rear gear 16 are coaxial with the propeller shaft 18. The front gear 15 and the rear gear 16 surround the propeller shaft 18 with an interval between the front gear 15 and the rear gear 16. The front gear 15 is disposed in front of the rear gear 16. The dog clutch 17 is disposed between the front gear 15 and the rear gear 16. When the rotation of the engine 10 is transmitted to the pinion 14 through the drive shaft 12, the front gear 15 and the rear gear 16 rotate in mutually opposite directions.

The dog clutch 17 is movable in an axial direction of the propeller shaft 18 with respect to the propeller shaft 18, and rotates together with the propeller shaft 18. When the dog clutch 17 engages with the front gear 15, the rotation in a normal rotation direction is transmitted from the front gear 15 to the propeller shaft 18 through the dog clutch 17. Thus, the propeller 19 rotates in the normal rotation direction. When the dog clutch 17 engages with the rear gear 16, the rotation in a reverse rotation direction is transmitted from the rear gear 16 to the propeller shaft 18 through the dog clutch 17. Thus, the propeller 19 rotates in the reverse rotation direction.

Figure 2:
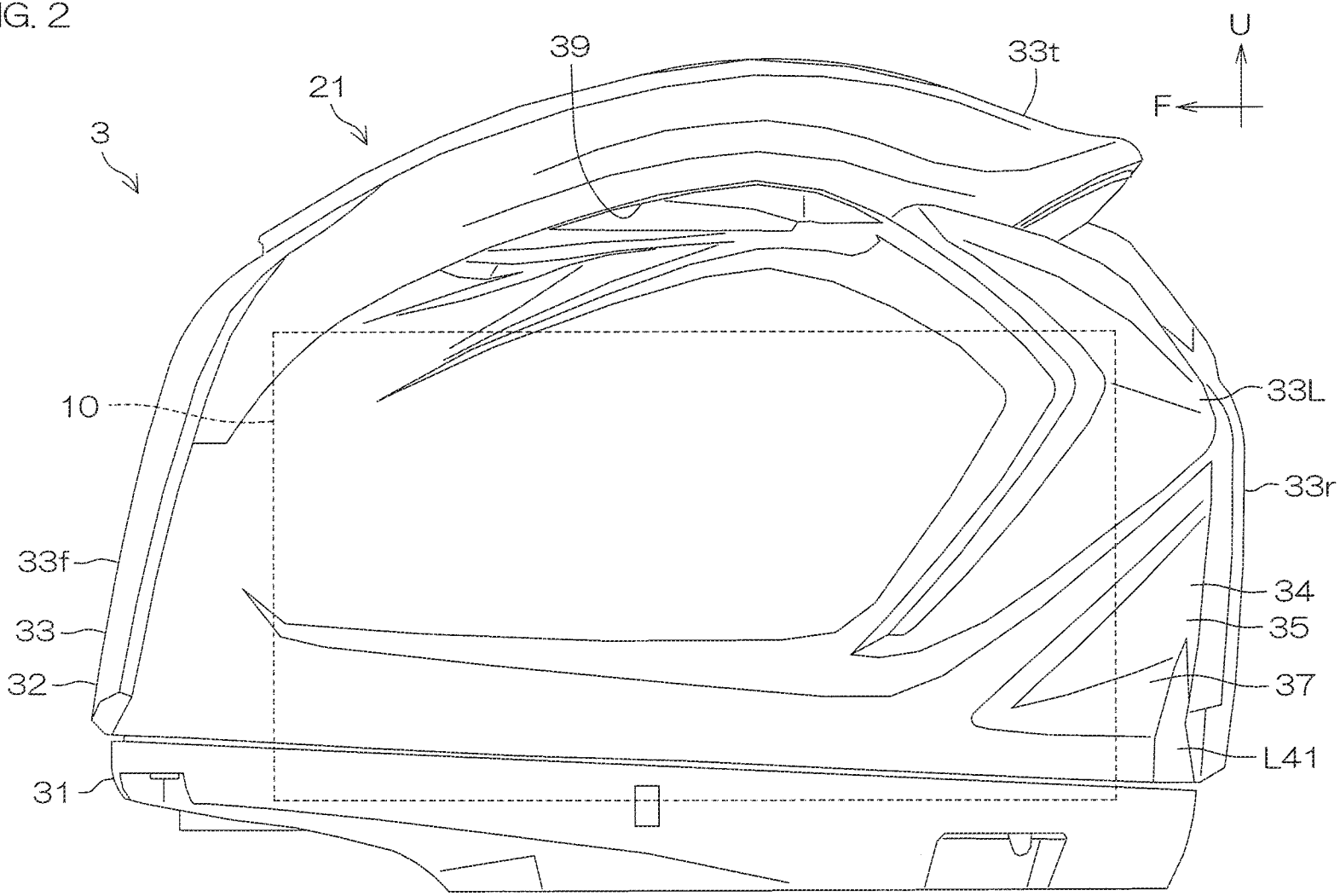
FIG. 2 is a left side view of an engine cover provided on the outboard motor.
Figure 3:
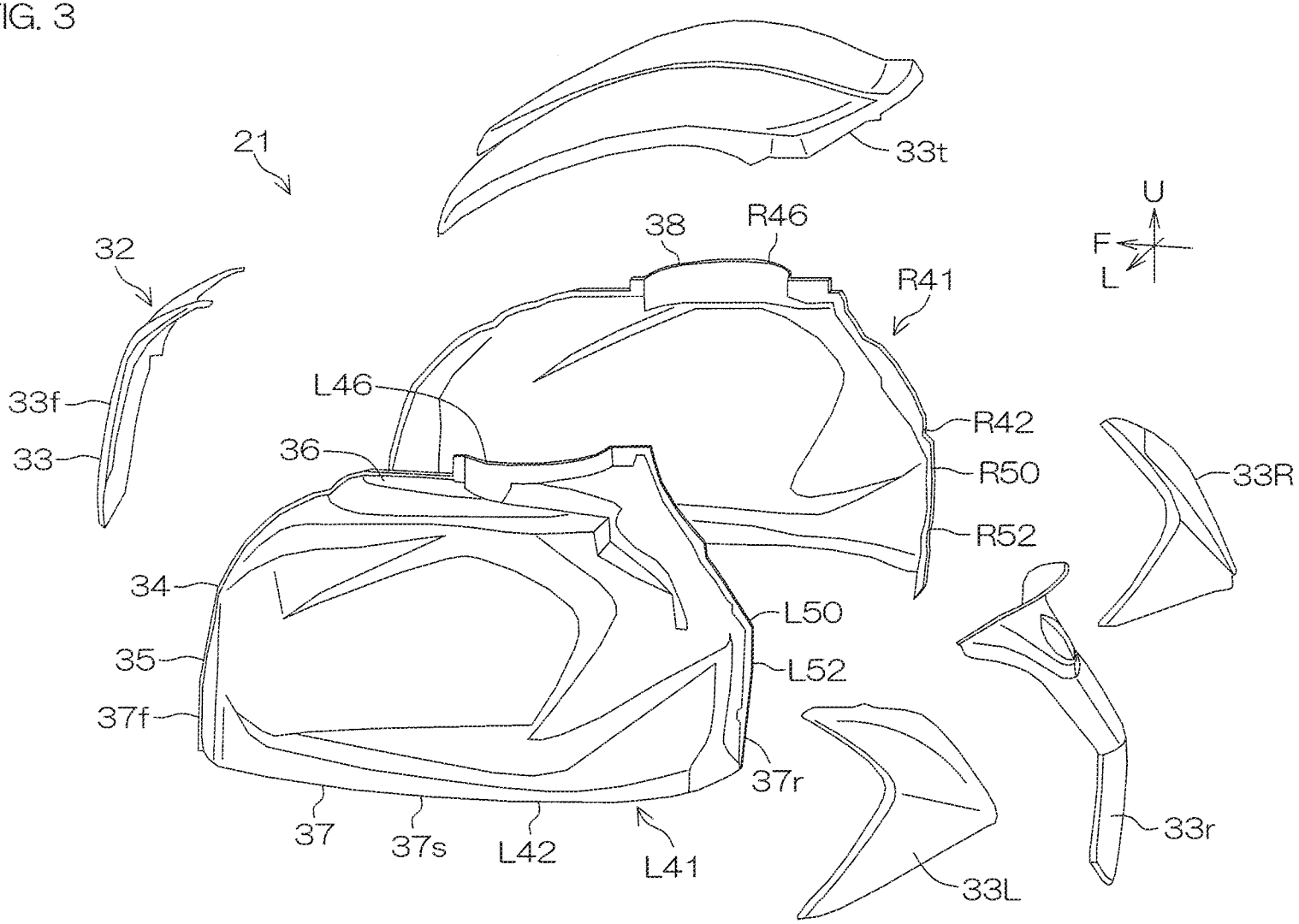
FIG. 3 is an exploded perspective view of a top cover provided on the engine cover.
Figure 4:
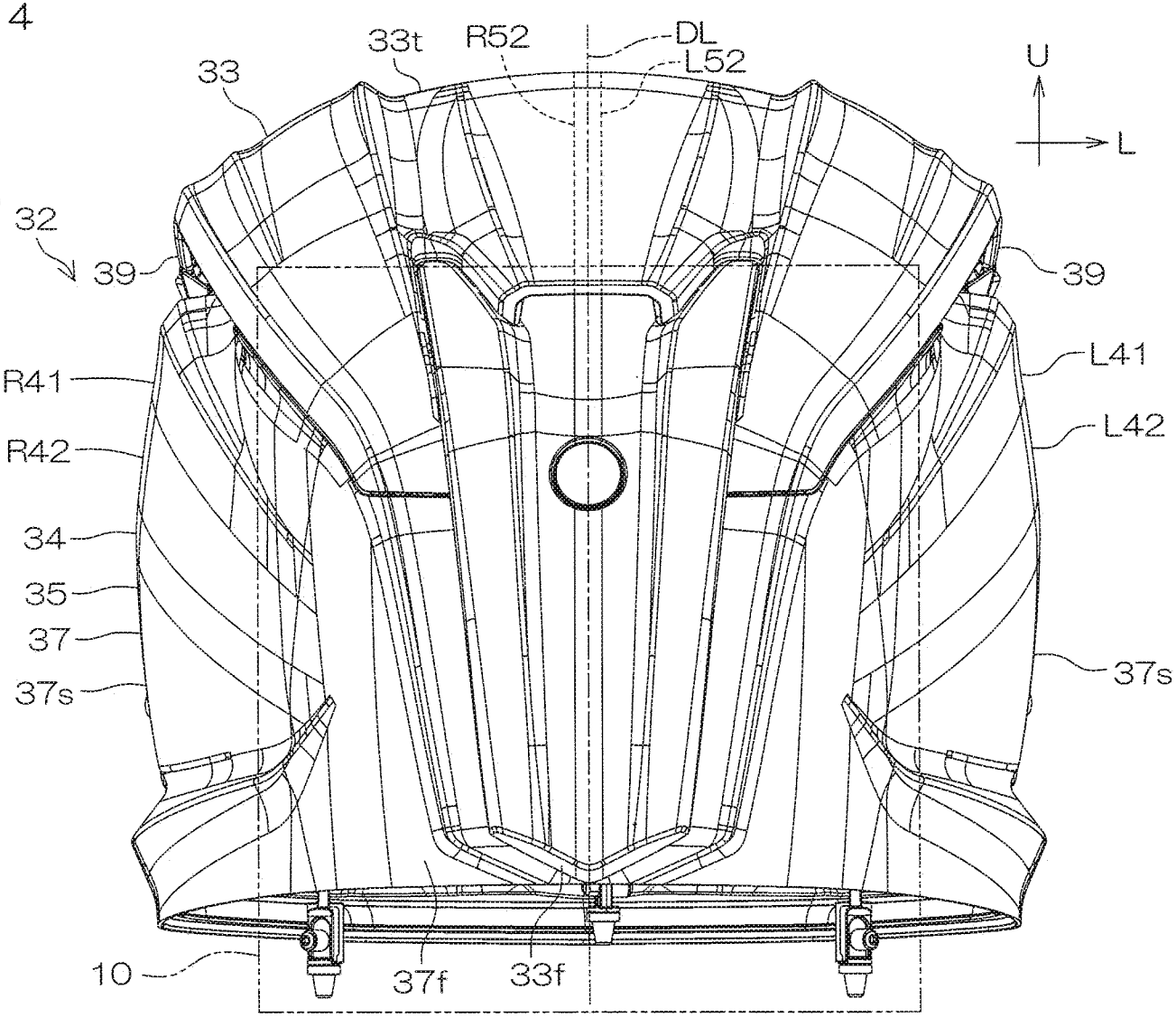
FIG. 4 is a front view of the top cover.

FIG. 2 is a left side view of the engine cover 21 provided on the outboard motor 3. FIG. 3 is an exploded perspective view of a top cover 32 provided on the engine cover 21. FIG. 4 is a front view of the top cover 32.

The engine cover 21 is an exterior component that is referred to also as an engine cowl. As shown in FIG. 2, the engine cover 21 includes a top cover 32 that houses an upper portion of the engine 10 and a bottom cover 31 that houses a lower portion of the engine 10. The top cover 32 preferably has the shape of a cup directed downwardly. The engine 10 is covered with the top cover 32 from above the engine 10. The bottom cover 31 is disposed below the top cover 32. A cylindrical lower end portion of the top cover 32 is fitted to a cylindrical upper end portion of the bottom cover 31. A gap between the top cover 32 and the bottom cover 31 is sealed with a seal. The top cover 32 is supported by the bottom cover 31. The bottom cover 31 is attached to the exhaust guide 22 (see FIG. 1).

The engine 10 is disposed between the top cover 32 and the bottom cover 31 in the up-down direction. An inner surface of the top cover 32 and an inner surface of the bottom cover 31 define a housing chamber that houses the entirety of the engine 10. The top cover 32 surrounds the engine 10 over the whole circumference of the engine 10, and overlaps the engine 10 in a plan view. The bottom cover 31 is disposed below the engine 10, and overlaps the engine 10 in a plan view. The bottom cover 31 surrounds the engine 10 over the whole circumference of the engine 10.

The top cover 32 includes a main cover 34 that houses the engine 10 and at least one exterior panel 33 that is disposed on an outer surface of the main cover 34. FIG. 3 shows an example in which five exterior panels 33 are disposed. The five exterior panels 33 include a top panel 33*t* disposed above the main cover 34, a front panel 33*f* and a rear panel 33*r* disposed in front of and behind the main cover 34, respectively, and a right panel 33R and a left panel 33L disposed on the right side and on the left side of the main cover 34, respectively. Each exterior panel 33 is attached to the main cover 34.

The main cover 34 is divided rightwardly and leftwardly as shown in FIG. 3. The main cover 34 includes two divided covers connected to each other. One of the divided covers is a right divided cover R41, and the other divided cover is a left divided cover L41. The right divided cover R41 and the left divided cover L41 are arranged side by side in the right-left direction. The right divided cover R41 is disposed on the right side of the left divided cover L41. The engine 10 is disposed between the right divided cover R41 and the left divided cover L41. The right divided cover R41 and the left divided cover L41 face each other in the right-left direction with the engine 10 between the right divided cover R41 and the left divided cover L41.

The right divided cover R41 is a first divided cover, and the left divided cover L41 is a second divided cover. "Right" refers to the right divided cover R41 but can be referred to also as "First." "Left" refers to the left divided cover L41 but can be referred to also as "Second." For example, a right connection portion R52 of the right divided cover R41 is a first connection portion, and a left connection portion L52 of the left divided cover L41 is a second connection portion. The same applies to other portions or elements of the right and left divided covers R41 and L41 except the right and left connection portions R52 and L52.

The front panel 33*f*, the top panel 33*t*, and the rear panel 33*r* are disposed above the right divided cover R41 and the left divided cover L41, and overlap the right divided cover R41 and the left divided cover L41 in a plan view. The top panel 33*t* is disposed above an air intake ring 38 described below, and overlaps the air intake ring 38 in a plan view. The front panel 33*f*, the top panel 33*t*, and the rear panel 33*r* are attached to each of the right and left divided covers R41 and L41. The right panel 33R is attached to the right divided cover R41, and the left panel 33L is attached to the left divided cover L41. The right panel 33R is disposed on the right side of the right divided cover R41, and the left panel 33L is disposed on the left side of the left divided cover L41.

The front panel 33*f* and the rear panel 33*r* are spaced apart from each other in the front-rear direction. The top panel 33*t* extends forwardly from the rear panel 33*r* to the front panel 33*f*. The front panel 33*f* and the rear panel 33*r* extend downwardly from the top panel 33*t*. A lower end of the front panel 33*f* is disposed at a lower position than a lower end of the top panel 33*t*. Likewise, a lower end of the rear panel 33*r* is disposed at a lower position than the lower end of the top panel 33*t*. The rear panel 33*r* is disposed between the right panel 33R and the left panel 33L in the left-right direction.

An outer surface of the engine cover 21 defines an air intake port 39 through which air that is supplied to the engine 10 passes. FIG. 2 shows the air intake port 39 that is open in a left side surface of the engine cover 21. The air intake port 39 shown in FIG. 2 is defined by the top panel 33*t* and the left divided cover L41. Air outside the engine cover 21 flows from the air intake port 39 that is open in the outer surface of the engine cover 21 into a space between the top panel 33*t* and the main cover 34. Thereafter, this air enters the main cover 34 through the air intake ring 38. Thus, air is supplied to the engine 10.

The right divided cover R41 and the left divided cover L41 include two connection portions connected to each other as shown in FIG. 3. One of the connection portions is a right connection portion R52 disposed at the right divided cover R41, and the other connection portion is a left connection portion L52 disposed at the left divided cover L41. The right connection portion R52 and the left connection portion L52 are fitted to each other, and are contiguous with each other as shown in FIG. 4. The top panel 33*t*, the front panel 33*f*, and the rear panel 33*r* are disposed outside the main cover 34, i.e., are disposed outside the right and left divided covers R41 and L41, and overlaps the right and left connection portions R52 and L52. The front panel 33*f*, the top panel 33*t*, and the rear panel 33*r* covers the entirety of or substantially the entirety of the right and left connection portions R52 and L52.

Figure 5:
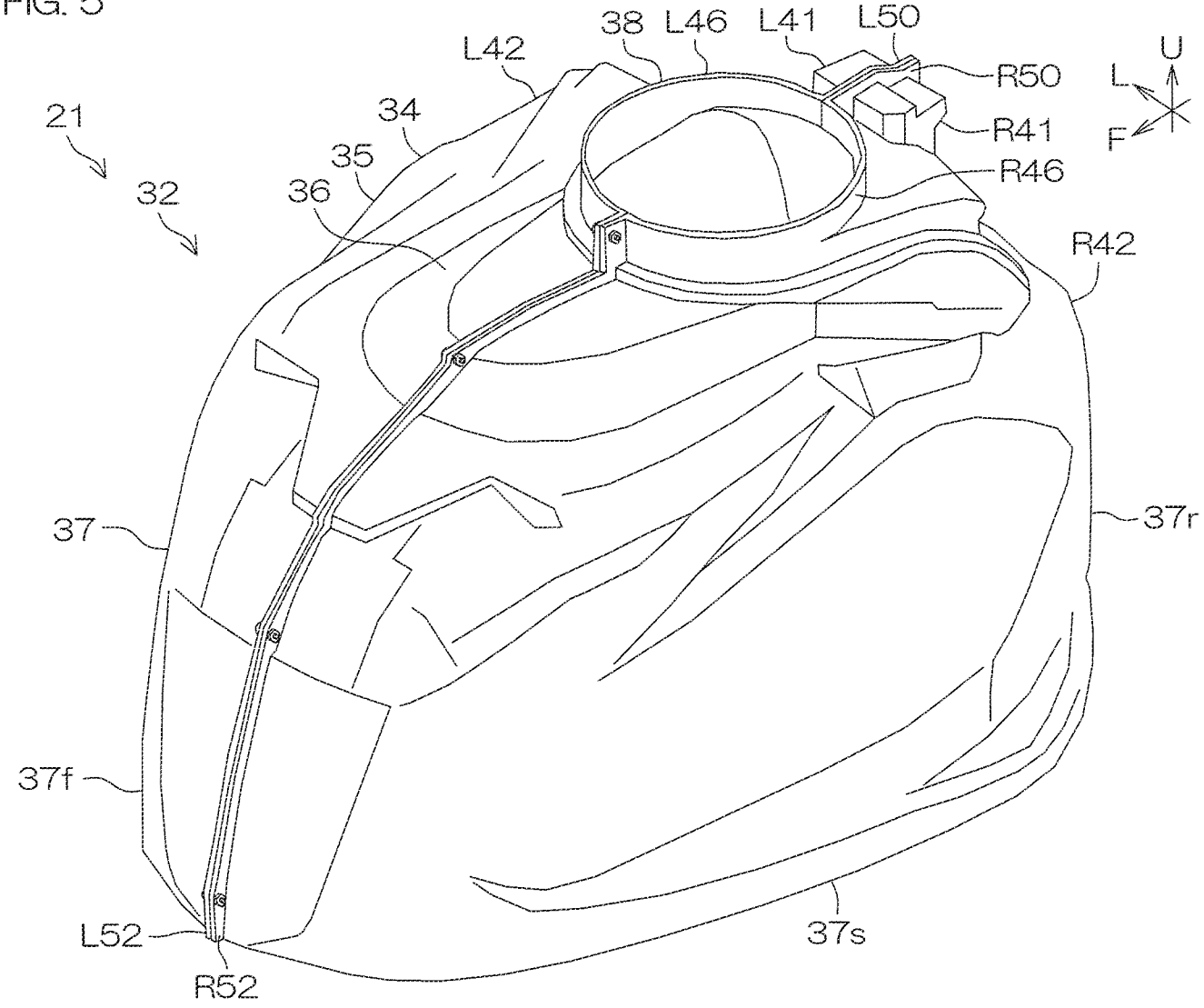
FIG. 5 is a perspective view of a main cover provided on the top cover.
Figure 6:
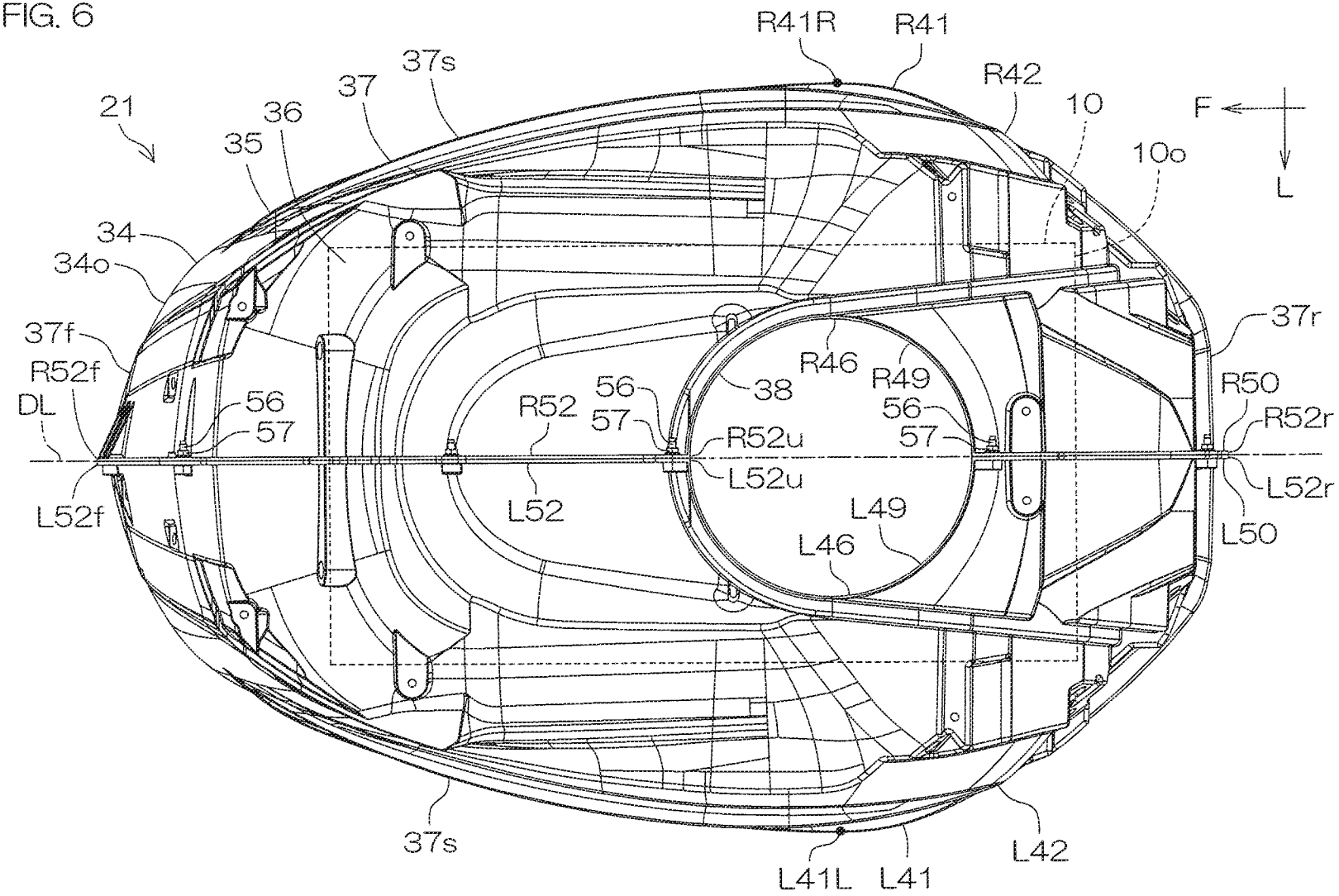
FIG. 6 is a plan view of the main cover showing a state in which a right divided cover and a left divided cover have been connected together.
Figure 7:
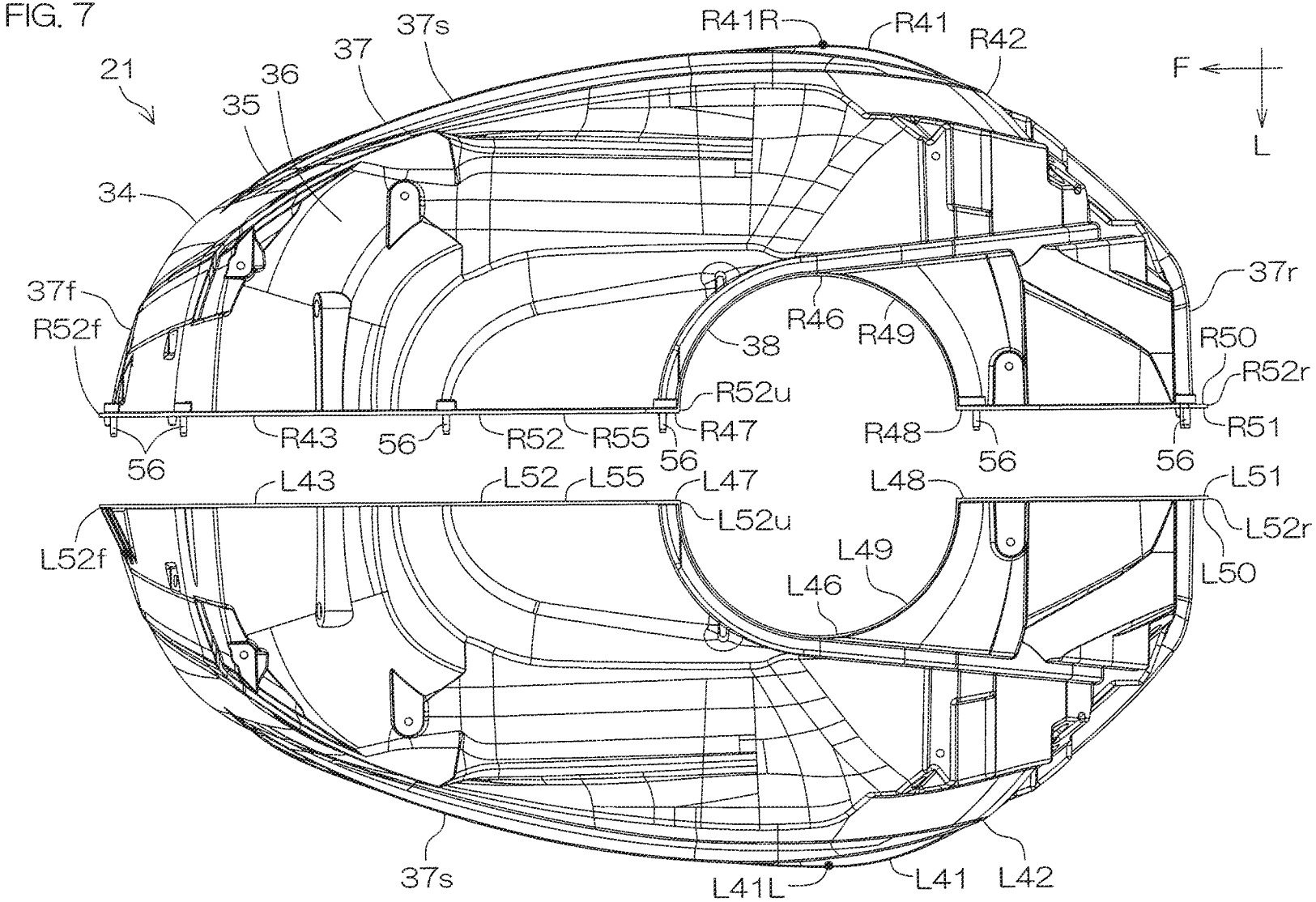
FIG. 7 is a plan view of the main cover showing a state in which the right divided cover and the left divided cover are spaced apart from each other.
Figure 8:
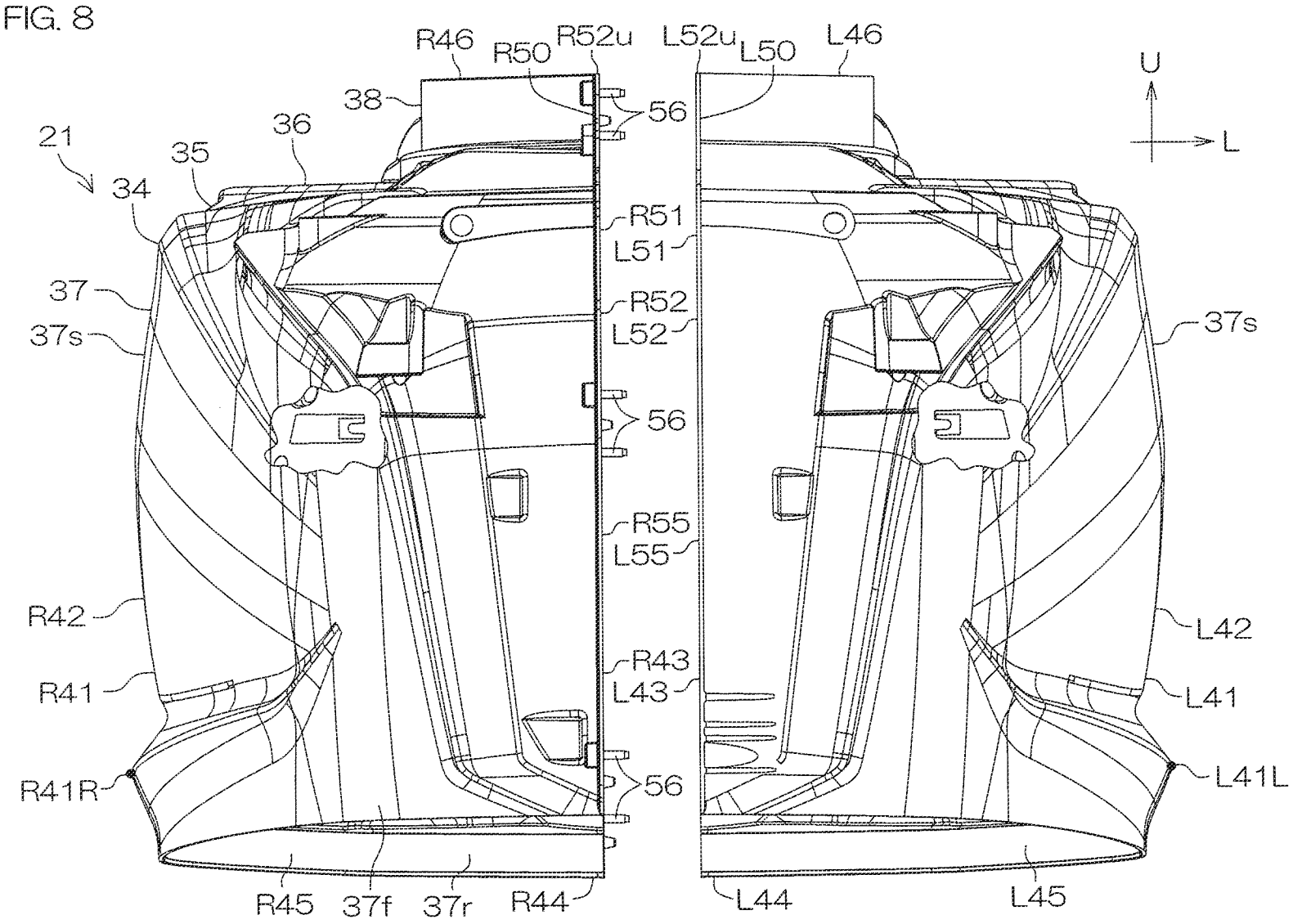
FIG. 8 is a front view of the main cover showing a state in which the right divided cover and the left divided cover are spaced apart from each other.
Figure 9:
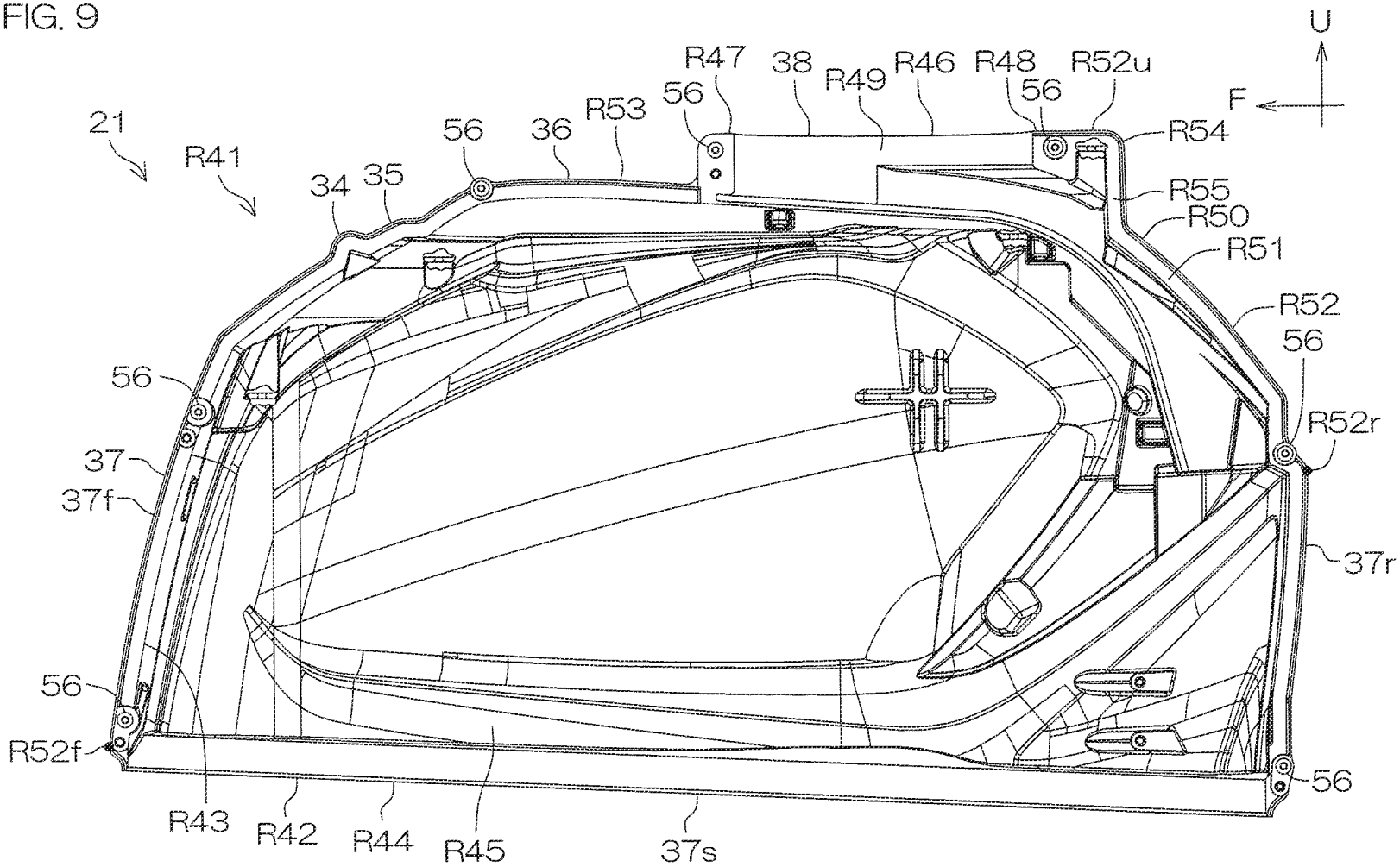
FIG. 9 is a left side view of the right divided cover.
Figure 10:
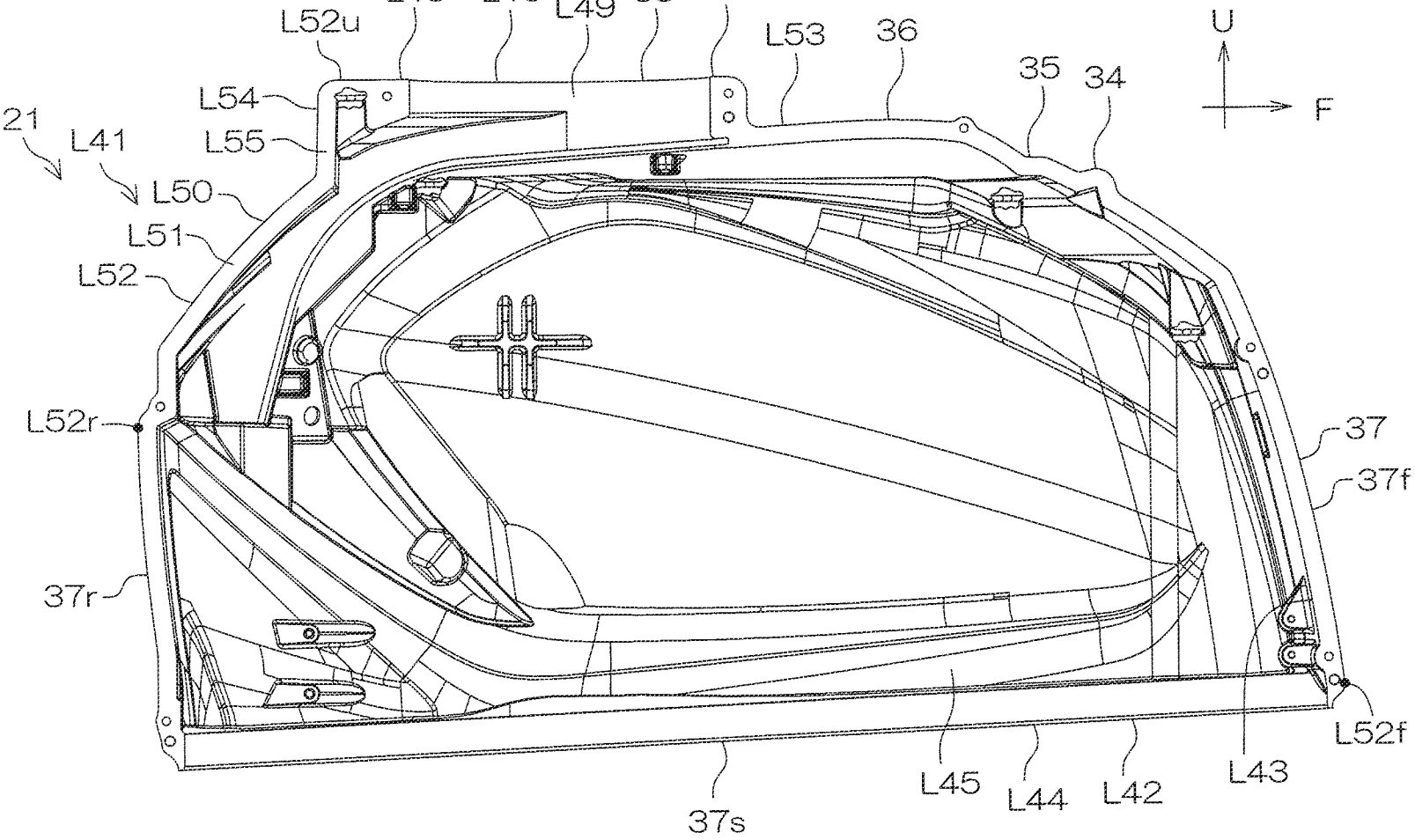
FIG. 10 is a right side view of the left divided cover.
Figure 11:
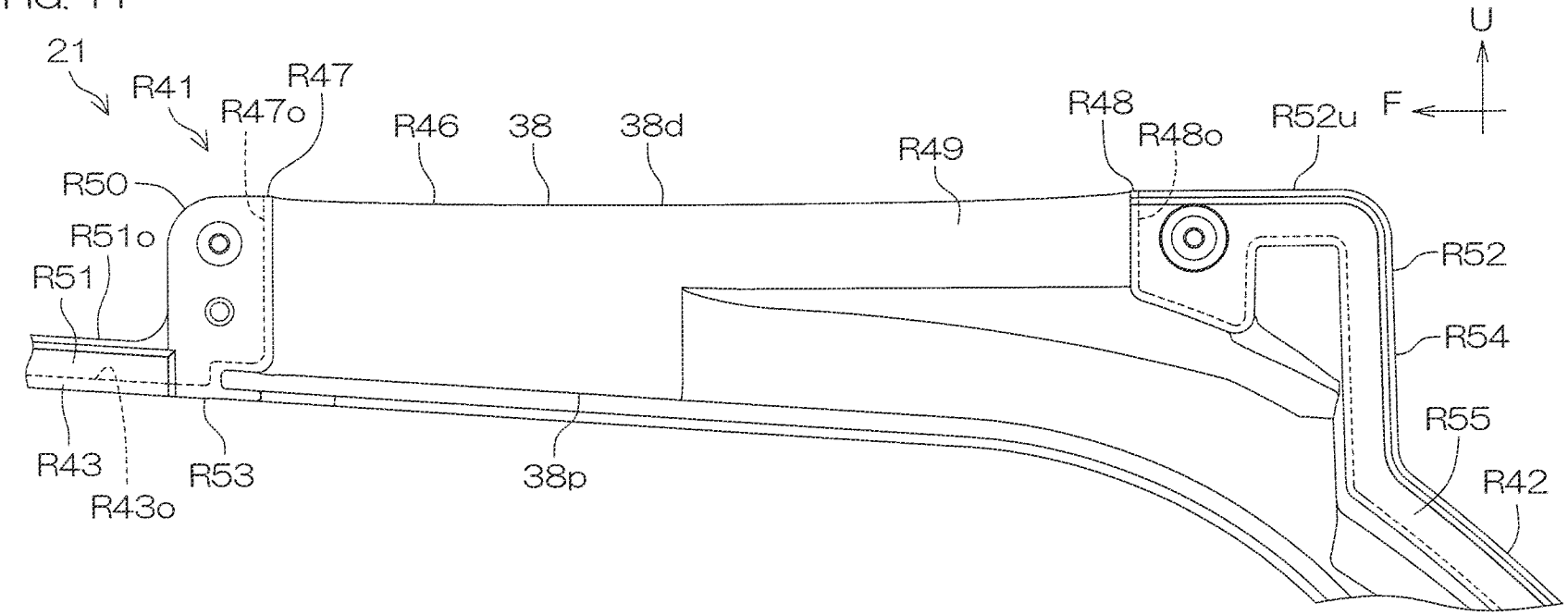
FIG. 11 is a partially enlarged view of FIG. 9.

FIG. 5 is a perspective view of the main cover 34 provided on the top cover 32. FIG. 6 is a plan view of the main cover 34 showing a state in which the right divided cover R41 and the left divided cover L41 have been connected together. FIG. 7 and FIG. 8 are a plan view and a front view, respectively, of the main cover 34 showing a state in which the right divided cover R41 and the left divided cover L41 are spaced apart from each other. FIG. 9 is a left side view of the right divided cover R41. FIG. 10 is a right side view of the left divided cover L41. FIG. 11 is a partially enlarged view of FIG. 9.

The main cover 34 preferably has the shape of a cup directed downwardly as shown in FIG. 5. An opening defined by a cylindrical lower end portion of the main cover 34 is covered by the bottom cover 31 (see FIG. 2). The main cover 34 includes a housing 35 that houses the engine 10 and a cylindrical air intake ring 38 that guides air from the outside of the housing 35 to the inside of the housing 35. The housing 35 and the air intake ring 38 are each divided into two pieces.

The housing 35 includes a cylindrical peripheral wall 37 surrounding the engine 10 over the whole circumference of the engine 10 and an upper wall 36 positioned above the engine 10 as shown in FIG. 6. The air intake ring 38 extends upwardly from the upper wall 36. The upper wall 36 and the air intake ring 38 overlap the engine 10 in a plan view. The peripheral wall 37 extends downwardly from the whole circumference of the upper wall 36. The peripheral wall 37 includes a front wall 37*f* positioned in front of the engine 10, a rear wall 37*r* positioned behind the engine 10, and a pair of sidewalls 37*s* respectively positioned on the right side and on the left side of the engine 10.

An inner surface of the main cover 34 corresponds to the inner surface of the top cover 32. An undersurface of the upper wall 36 and an inner peripheral surface of the peripheral wall 37 are included in the inner surface of the main cover 34. The undersurface of the upper wall 36 directly faces the engine 10 in the vertical direction. The inner peripheral surface of the peripheral wall 37 directly faces the engine 10 in the horizontal direction. Therefore, the inner surface of the main cover 34 directly faces the engine 10. The inner surface of the main cover 34 may directly face a main component, such as a cylinder head or a cylinder body, of the engine 10, or may directly face an accessory component, such as a cover attached to the main component, of the engine 10.

The air intake ring 38 has a cylindrical shape extending in the up-down direction. An inner peripheral surface of the air intake ring 38 is open in an inner surface of the housing 35. FIG. 6 shows an example in which the air intake ring 38 is circularly cylindrical, for example. If it is cylindrical, the air intake ring 38 may have any shape other than the circularly cylindrical shape. The inner diameter and the outer diameter of the air intake ring 38 are fixed from a base end 38*p* of the air intake ring 38 (see FIG. 11) to a front end 38*d* of the air intake ring 38 (see FIG. 11). The height of the air intake ring 38, i.e., the distance in an axial direction of the air intake ring 38 (i.e., in a direction of a center line of the air intake ring 38) from the base end 38*p* of the air intake ring 38 to the front end 38*d* of the air intake ring 38, is smaller than the inner diameter and the outer diameter of the air intake ring 38.

The main cover 34 is larger than the engine 10 in a plan view. The main cover 34 is longer than the engine 10 in the left-right direction, and is longer than the engine 10 in the front-rear direction. An outline 34*o* of the main cover 34 in a plan view corresponds to an outline of the right divided cover R41 and an outline of the left divided cover L41 in a plan view. At least a portion of the outline 34*o* of the main cover 34 in a plan view is disposed outside an outline 10*o* of the engine 10 in a plan view. FIG. 6 shows an example in which the outline 34*o* of the main cover 34 in a plan view surrounds the outline 10*o* of the engine 10 in a plan view over the whole circumference of the engine 10. Any portion of the outline 34*o* of the main cover 34 in a plan view is disposed outside the outline 10*o* of the engine 10 in a plan view.

As is understood from a comparison between FIG. 6 and FIG. 7, the main cover 34 is divided by a division line DL. The division line DL is a virtual plane showing a boundary between the right divided cover R41 and the left divided cover L41. The division line DL may be one or more flat surfaces or curved surfaces, or may include both a flat surface and a curved surface. FIG. 6 shows an example in which the division line DL is a vertical flat surface and is a straight line in a plan view. The division line DL is a straight line perpendicular to the left-right direction in a plan view, and extends from a location in front of the engine 10 to a location behind the engine 10 in a plan view.

The division line DL showing the boundary between the right divided cover R41 and the left divided cover L41 passes through a location in which a distance from a right end R41R of the right divided cover R41 and a distance from a left end L41L of the left divided cover L41 are equal or substantially equal to each other in a plan view. In other words, the main cover 34 is divided into two pieces at a center of the main cover 34 in the left-right direction. The right divided cover R41 and the left divided cover L41 are plane-symmetric or substantially plane-symmetric with respect to the division line DL. The right divided cover R41 and the left divided cover L41 may be asymmetric with respect to the division line DL. The division line DL passes through the housing 35 and through the air intake ring 38.

The right divided cover R41 includes a right housing portion R42 that defines a portion of the housing 35 of the main cover 34, a right band portion R46 that defines a portion of the air intake ring 38 of the main cover 34, and a right flange portion R50 that protrudes outwardly from the right housing portion R42 and from the right band portion R46. The left divided cover L41 includes a left housing portion L42 that defines a remaining portion of the housing 35, a left band portion L46 that defines a remaining portion of the air intake ring 38, and a left flange portion L50 that protrudes outwardly from the left housing portion L42 and from the left band portion L46.

The right divided cover R41 and the left divided cover L41 are each a single unitary member as shown in FIG. 7 and FIG. 8. The right housing portion R42 is integral and unitary with the right band portion R46 and with the right flange portion R50. The left housing portion L42 is integral and unitary with the left band portion L46 and with the left flange portion L50. The right housing portion R42, the right band portion R46, and the right flange portion R50 are contiguous to the left housing portion L42, the left band portion L46, and the left flange portion L50, respectively, on the division line DL as shown in FIG. 6.

The right divided cover R41 may be made of synthetic resin, or may be made of metal, or may be made of a material other than these materials. The same applies to the left divided cover L41. The material of the right divided cover R41 may be the same as the material of the left divided cover L41, or may be different from the material of the left divided cover L41. The synthetic resin may be, for example, fiber reinforced plastics (FRP) that are reinforced with fibers, such as glass fibers or carbon fibers. If the right divided cover R41 and the left divided cover L41 are each made of FRP, the right divided cover R41 and the left divided cover L41 may be molded by an SMC molding method that uses a sheet molding compound (SMC), for example.

If the right and left divided covers R41 and L41 are molded by the SMC molding method, the right divided cover R41 or the left divided cover L41 may be molded from its upper portion or from its lateral portion. In other words, the up-down direction of the right divided cover R41 or of the left divided cover L41 may be made to coincide with a compression direction in which the SMC that is a sheet-shaped material is compressed by a mold, or the left-right direction of the right divided cover R41 or of the left divided cover L41 may be made to coincide with the compression direction of the SMC.

When the right divided cover R41 or the left divided cover L41 is molded from its upper portion, a side surface of the main cover 34 (a right side surface of the right divided cover R41 or a left side surface of the left divided cover L41) is restricted to such a shape as not to generate an undercut. This restriction is not imposed on the side surface of the main cover 34 when the right divided cover R41 or the left divided cover L41 is molded from its side portion. Therefore, it is possible to increase the degree of freedom of the shape of the side surface of the main cover 34. Additionally, it is possible to make the degree of smoothness of the side surface of the main cover 34 higher than when the right divided cover R41 or the left divided cover L41 is molded from its upper portion.

When an SMC is compressed by a mold, the SMC flows in the mold, and is then hardened, and, as a result, the right divided cover R41 or the left divided cover L41 is molded. The right and left divided covers R41 and L41 are short in the left-right direction, and therefore, when the right divided cover R41 or the left divided cover L41 is molded from its side portion, the flow length of the SMC is shorter than when the right divided cover R41 or the left divided cover L41 is molded from its upper portion. If the flow length of the SMC is long, there is a possibility that a defect in molding or a decrease in strength will occur in a finally filled portion that the SMC reaches lastly. These disadvantages are able to be avoided if an SMC whose hardening rate is low is used, and yet restrictions will be imposed on the kind of the SMC. If its kind is restricted to an SMC whose density is high, it is impossible to lighten the engine cover 21. These disadvantages are able to be avoided if the right divided cover R41 or the left divided cover L41 is molded from its side portion.

As shown in FIG. 9, the right housing portion R42 includes an inner surface R45 that directly faces the engine 10, a flat lateral end surface R43 contiguous to the left housing portion L42, and a downward side end surface R44 disposed around the bottom cover 31 (see FIG. 2). The lateral end surface R43 preferably has the shape of the letter U that is upwardly convex. The downward side end surface R44 preferably has the shape of the letter U that is rightwardly convex. The lateral end surface R43 extends upwardly from the downward side end surface R44. The inner surface R45 is concaved rightwardly from the lateral end surface R43.

As shown in FIG. 10, the left housing portion L42 includes an inner surface L45 that directly faces the engine 10, a flat lateral end surface L43 contiguous to the right housing portion R42, and a downward side end surface L44 disposed around the bottom cover 31. The lateral end surface L43 preferably has the shape of the letter U that is upwardly convex. The downward side end surface L44 preferably has the shape of the letter U that is leftwardly convex. The lateral end surface L43 extends upwardly from the downward side end surface L44. The inner surface L45 is concaved leftwardly from the lateral end surface L43. The lateral end surface L43 is fitted to and contiguous with the lateral end surface R43 of the right housing portion R42.

The right band portion R46 is concaved rightwardly from the lateral end surface R43 of the right housing portion R42 as shown in FIG. 7. The lateral end surface R43 is divided into two pieces in front of and behind the right band portion R46. The right band portion R46 includes two flat end surfaces contiguous to the left band portion L46 and an inner surface R49 extending from one of the end surfaces to the other end surface. One of the two end surfaces is a flat front end surface R47 extending forwardly from the inner surface R49, and the other end surface is a flat rear end surface R48 extending rearwardly from the inner surface R49. The front end surface R47 and the rear end surface R48 correspond to both ends of the right band portion R46.

The left band portion L46 is concaved leftwardly from the lateral end surface L43 of the left housing portion L42. The lateral end surface L43 is divided into two pieces in front of and behind the left band portion L46. The left band portion L46 includes two flat end surfaces contiguous with the right band portion R46 and an inner surface L49 extending from one of the end surfaces to the other end surface. One of the two end surfaces is a flat front end surface L47 extending forwardly from the inner surface L49, and the other end surface is a flat rear end surface L48 extending rearwardly from the inner surface L49. The front end surface L47 and the rear end surface L48 correspond to both ends of the left band portion L46.

The front end surface R47 and the rear end surface R48 of the right band portion R46 extend upwardly from the lateral end surface R43 of the right housing portion R42 as shown in FIG. 9. The front end surface R47 and the rear end surface R48 are disposed on a single plane including the lateral end surface R43. The inner surface R49 of the right band portion R46 is concaved rightwardly from the front end surface R47 and from the rear end surface R48. The inner surface R49 extends upwardly from the inner surface R45 of the right housing portion R42.

The front end surface L47 and the rear end surface L48 of the left band portion L46 extend upwardly from the lateral end surface L43 of the left housing portion L42 as shown in FIG. 10. The front end surface L47 and the rear end surface L48 are disposed on a single plane including the lateral end surface L43. The inner surface L49 of the left band portion L46 is concaved leftwardly from the front end surface L47 and from the rear end surface L48. The inner surface L49 extends upwardly from the inner surface L45 of the left housing portion L42.

The front end surface R47 and the rear end surface R48 of the right band portion R46 are contiguous with the front end surface L47 and the rear end surface L48, respectively, of the left band portion L46. The inner surface R49 of the right band portion R46 and the inner surface L49 of the left band portion L46 are spaced apart from each other in the right-left direction. The inner surface R49 defines a portion of the inner peripheral surface of the air intake ring 38, and the inner surface L49 defines a remaining portion of the inner peripheral surface of the air intake ring 38. The inner surface R49 and the inner surface L49 each preferably have a semicircular shape in a plan view.

The right flange portion R50 includes a flat end surface R51 protruding outwardly from the lateral end surface R43 of the right housing portion R42 as shown in FIG. 9. The end surface R51 protrudes forwardly from the front end surface R47 of the right band portion R46, and protrudes rearwardly from the rear end surface R48 of the right band portion R46. Therefore, the end surface R51 likewise protrudes outwardly from both the front end surface R47 and the rear end surface R48 of the right band portion R46.

The right flange portion R50 extends in a longitudinal direction of the lateral end surface R43 along the lateral end surface R43 of the right housing portion R42. The right flange portion R50 extends in the axial direction of the air intake ring 38 along the front end surface R47 and the rear end surface R48 of the right band portion R46. The right flange portion R50 is disposed at any location along the lateral end surface R43. The right flange portion R50 is disposed at any location along the front and rear end surfaces R47 and R48.

The left flange portion L50 includes a flat end surface L51 protruding outwardly from the lateral end surface L43 of the left housing portion L42 as shown in FIG. 10. The end surface L51 protrudes forwardly from the front end surface L47 of the left band portion L46, and protrudes rearwardly from the rear end surface L48 of the left band portion L46. Therefore, the end surface L51 likewise protrudes outwardly from both the front end surface L47 and the rear end surface L48 of the left band portion L46.

The left flange portion L50 extends in the longitudinal direction of the lateral end surface L43 along the lateral end surface L43 of the left housing portion L42. The left flange portion L50 extends in the axial direction of the air intake ring 38 along the front end surface L47 and the rear end surface L48 of the left band portion L46. The left flange portion L50 is disposed at any location along the lateral end surface L43. The left flange portion L50 is disposed at any location along the front and rear end surfaces L47 and L48.

The end surface R51 of the right flange portion R50 and the end surface L51 of the left flange portion L50 are fitted to each other, and contiguous with each other. The end surface R51 of the right flange portion R50 is disposed on a single plane that includes the lateral end surface R43 of the right housing portion R42 and the front and rear end surfaces R47 and R48 of the right band portion R46. Likewise, the end surface L51 of the left flange portion L50 is disposed on a single plane that includes the lateral end surface L43 of the left housing portion L42 and the front and rear end surfaces L47 and L48 of the left band portion L46.

An outer edge R51*o* of the end surface R51 of the right flange portion R50 is disposed around an outer edge R43*o* of the lateral end surface R43 of the right housing portion R42 as shown in FIG. 11. The outer edge R51*o* of the end surface R51 is disposed in front of an outer edge R47*o* of the front end surface R47 of the right band portion R46. The outer edge R51*o* of the end surface R51 is disposed behind an outer edge R48*o* of the rear end surface R48 of the right band portion R46.

The height of the right flange portion R50 is a shortest distance from the outer edge R43*o* of the lateral end surface R43 to the outer edge R51*o* of the end surface R51. The height of the right flange portion R50 corresponds to the width of the right flange portion R50. The thickness of the right flange portion R50 is the distance of the right flange portion R50 in a direction perpendicular to the lateral end surface R43. The height of the right flange portion R50 is larger than the thickness of the right flange portion R50. The height of the right flange portion R50 is smaller than the height of the air intake ring 38, i.e., a distance from the base end 38*p* of the air intake ring 38 to the front end 38*d* of the air intake ring 38 in the axial direction of the air intake ring 38.

An outer edge of the end surface L51 of the left flange portion L50 is disposed around an outer edge of the lateral end surface L43 of the left housing portion L42. The outer edge of the end surface L51 is disposed in front of an outer edge of the front end surface L47 of the left band portion L46. The outer edge of the end surface L51 is disposed behind an outer edge of the rear end surface L48 of the left band portion L46. The height of the left flange portion L50 is a shortest distance from the outer edge of the lateral end surface L43 to the outer edge of the end surface R51. The height of the left flange portion L50 corresponds to the width of the left flange portion L50. The thickness of the left flange portion L50 is the distance of the left flange portion L50 in a direction perpendicular to the lateral end surface L43. The height of the left flange portion L50 is larger than the thickness of the left flange portion L50. The height of the left flange portion L50 is smaller than the height of the air intake ring 38.

As described above, the right divided cover R41 and the left divided cover L41 include the right connection portion R52 and the left connection portion L52 connected to each other. The right connection portion R52 is defined by the right flange portion R50, the right housing portion R42, and the right band portion R46. The left connection portion L52 is defined by the left flange portion L50, the left housing portion L42, and the left band portion L46. As shown in FIG. 6, the right connection portion R52 and the left connection portion L52 face each other in parallel. An interval between the right connection portion R52 and the left connection portion L52 is uniform at any location along the right connection portion R52 and the left connection portion L52. The right connection portion R52 and the left connection portion L52 are fitted to each other, and contiguous with each other.

The right connection portion R52 and the left connection portion L52 overlap the engine 10 in a plan view. The right connection portion R52 includes a front end R52*f* disposed in front of the engine 10, an upper end R52*u* disposed above the engine 10, and a rear end R52*r* disposed behind the engine 10. Likewise, the left connection portion L52 includes a front end L52*f* disposed in front of the engine 10, an upper end L52*u* disposed above the engine 10, and a rear end L52*r* disposed behind the engine 10. The upper end R52*u* of the right connection portion R52 and the upper end L52*u* of the left connection portion L52 overlap the engine 10 in a plan view. The front and rear ends R52*f* and R52*r* of the right connection portion R52 do not overlap the engine 10 in a plan view. Likewise, the front and rear ends L52*f* and L52*r* of the left connection portion L52 do not overlap the engine 10 in a plan view.

The right connection portion R52 and the left connection portion L52 extend along the division line DL in a front-rear direction. In other words, the right connection portion R52 and the left connection portion L52 define the division line DL. The right connection portion R52 and the left connection portion L52 are contiguous with each other on the division line DL. The front end R52*f*, the upper end R52*u*, and the rear end R52*r* of the right connection portion R52 are disposed along the division line DL. Likewise, the front end L52*f*, the upper end L52*u*, and the rear end L52*r* of the left connection portion L52 are disposed along the division line DL.

The right connection portion R52 is divided into two pieces in the front-rear direction with the right band portion R46 defining a boundary between the two pieces. The right connection portion R52 includes a front side connection portion R53 extending forwardly from the right band portion R46 along the right housing portion R42 and a rear connection portion R54 extending rearwardly from the right band portion R46 along the right housing portion R42 as shown in FIG. 9. Likewise, the left connection portion L52 is divided into two pieces in the front-rear direction with the left band portion L46 defining a boundary between the two pieces. The left connection portion L52 includes a front side connection portion L53 extending forwardly from the left band portion L46 along the left housing portion L42 and a rear connection portion L54 extending rearwardly from the left band portion L46 along the left housing portion L42 as shown in FIG. 10. The front side connection portion R53 is fitted on the front side connection portion L53, and the rear connection portion R54 is fitted on the rear connection portion L54.

The right connection portion R52 includes a flat end surface R55 facing the left connection portion L52 as shown in FIG. 9. The end surface R55 includes the end surface R51 of the right flange portion R50, the lateral end surface R43 of the right housing portion R42, and the front and rear end surfaces R47 and R48 of the right band portion R46. The left connection portion L52 includes a flat end surface L55 facing the right connection portion R52 as shown in FIG. 10. The end surface L55 includes the end surface L51 of the left flange portion L50, the lateral end surface L43 of the left housing portion L42, and the front and rear end surfaces L47 and L48 of the left band portion L46. The end surface R55 and the end surface L55 each include a flat surface that is positioned on the division line DL and that is parallel or substantially parallel to the division line DL.

The end surface R55 of the right connection portion R52 and the end surface L55 of the left connection portion L52 are parallel or substantially parallel to each other as shown in FIG. 7 and FIG. 8. An interval between the end surface R55 of the right connection portion R52 and the end surface L55 of the left connection portion L52 is uniform at any location. The end surface R55 of the right connection portion R52 and the end surface L55 of the left connection portion L52 are fitted to each other, and are contiguous with each other. Any portion of the end surface R55 of the right connection portion R52 is disposed on the division line DL. Likewise, any portion of the left parallel end of the left connection portion L52 is disposed on the division line DL.

The depth (i.e., length in the front-rear direction) of the right divided cover R41 is larger than the height (i.e., length in the up-down direction) of the right divided cover R41. The height of the right divided cover R41 is larger than the width (i.e., length in the left-right direction) of the right divided cover R41. Likewise, the depth of the left divided cover L41 is larger than the height of the left divided cover L41. The height of the left divided cover L41 is larger than the width of the left divided cover L41. The depth, the height, and the width of the right divided cover R41 are respectively equal or substantially equal to the depth, the height, and the width of the left divided cover L41. The depth of the right divided cover R41 and the depth of the left divided cover L41 correspond to the depth of the main cover 34. The height of the right divided cover R41 and the height of the left divided cover L41 correspond to the height of the main cover 34. The width of the main cover 34 is the distance from the right end R41R of the right divided cover R41 to the left end L41L of the left divided cover L41 in the left-right direction. The depth of the main cover 34 is larger than the height of the main cover 34. The width of the main cover 34 is larger than the height of the main cover 34. Each of these dimensions is an example, and the present invention is not limited to these dimensions.

Figure 12:
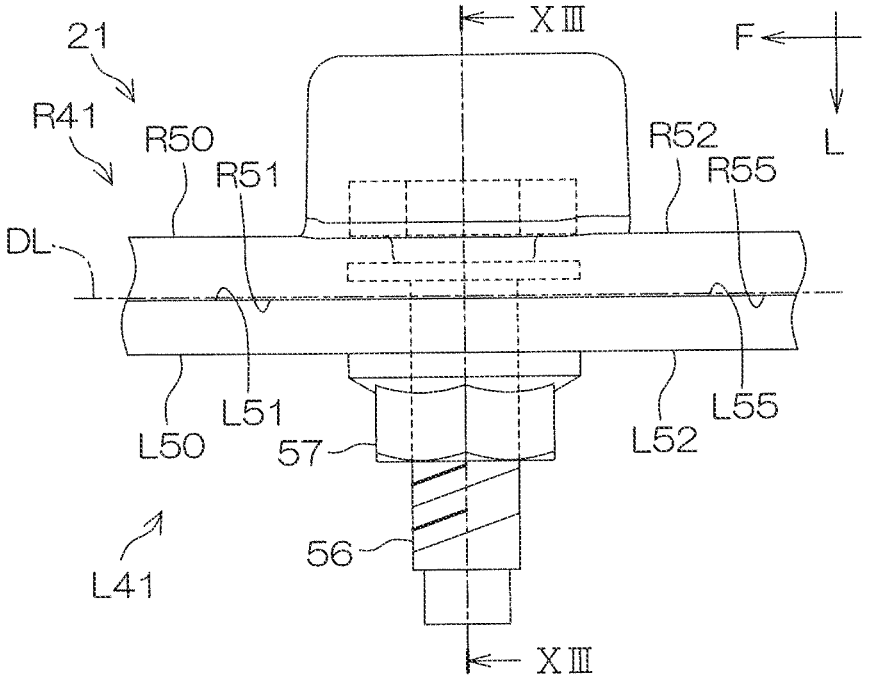
FIG. 12 is a plan view of a bolt by which a right connection portion of the right divided cover and a left connection portion of the left divided cover are connected together.
Figure 13:
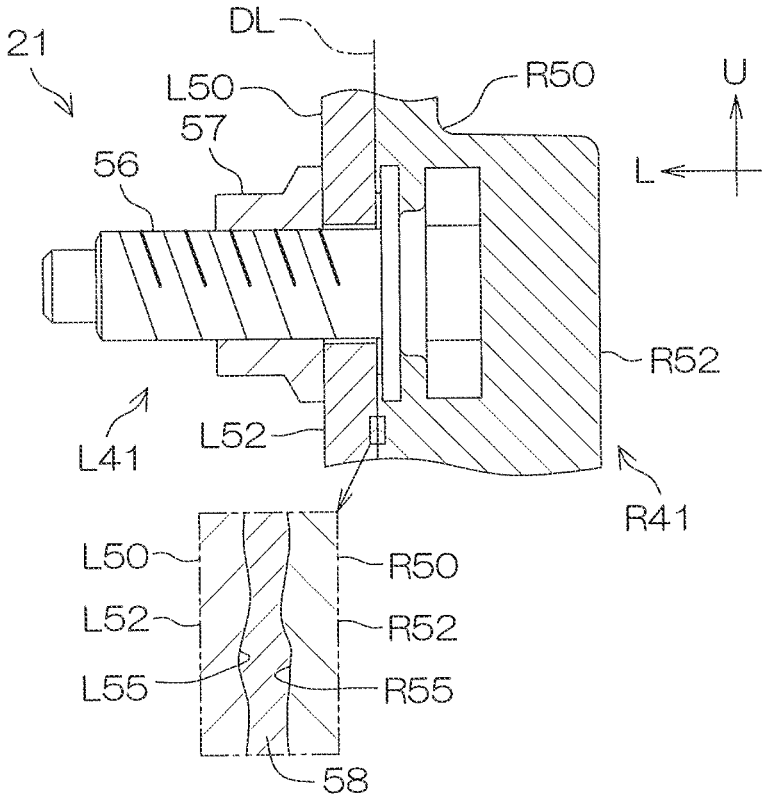
FIG. 13 is a cross-sectional view of both the right connection portion and the left connection portion along line XIII-XIII shown in FIG. 12.
Figure 14:
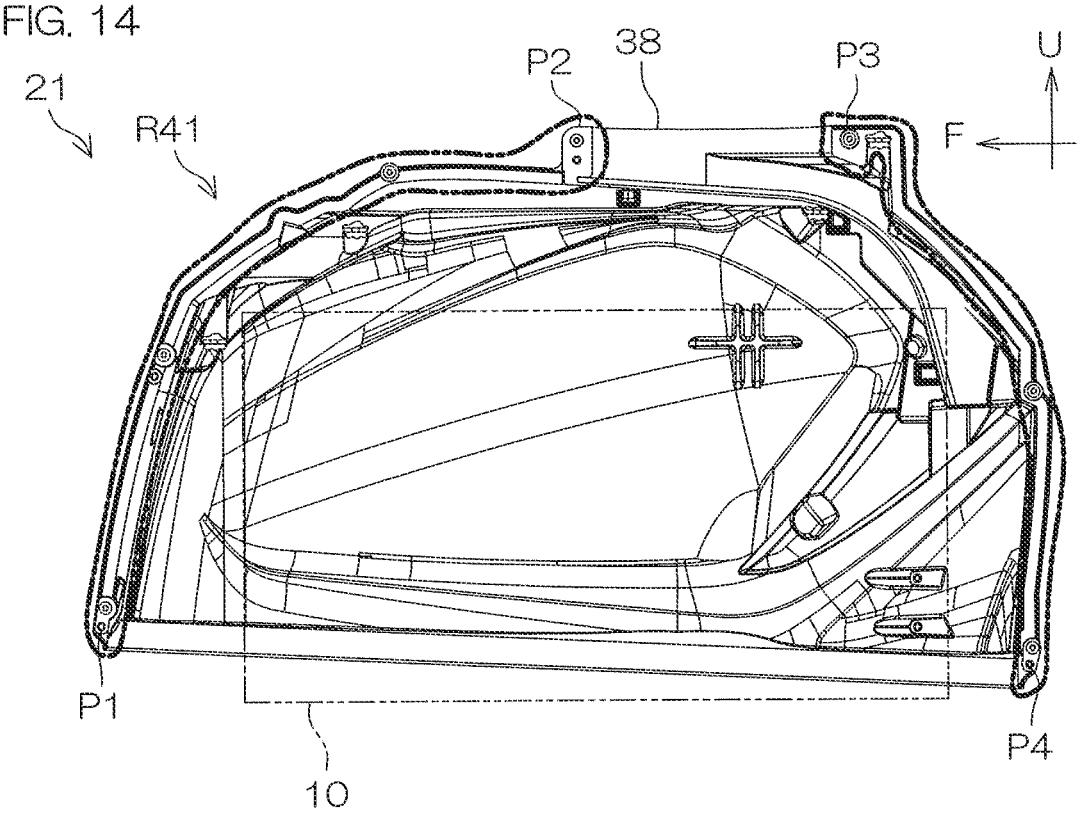
FIG. 14 is a left side view of the right divided cover showing an adhesive application range in which an adhesive by which the right connection portion and the left connection portion are bonded together is applied.

FIG. 12 is a plan view of a bolt 56 by which the right connection portion R52 of the right divided cover R41 and the left connection portion L52 of the left divided cover L41 are connected together. FIG. 13 is a cross-sectional view of the right and left connection portions R52 and L52 along line XIII-XIII shown in FIG. 12. FIG. 14 is a left side view of the right divided cover R41 showing an adhesive application range in which an adhesive by which the right connection portion R52 and the left connection portion L52 are bonded together is applied.

The right connection portion R52 of the right divided cover R41 and the left connection portion L52 of the left divided cover L41 are connected together by at least one bolt 56. FIG. 6 shows an example in which the right connection portion R52 and the left connection portion L52 are connected together by a plurality of pairs of bolts 56 and nuts 57 and in which a head portion of any bolt 56 is embedded in the right connection portion R52. A female thread into which a shank portion of the bolt 56 is inserted may be disposed at the left connection portion L52 instead of disposing the nut 57. A through hole into which the shank portion of the bolt 56 is inserted may be disposed at the right connection portion R52 instead of the head portion of the bolt 56 that is embedded in the right connection portion R52.

In the example shown in FIG. 12 and FIG. 13, the head portion of the bolt 56 is embedded in the right connection portion R52 by insert-molding, and the bolt 56 is fixed to the right divided cover R41. The shank portion of the bolt 56 protrudes from the end surface R55 of the right connection portion R52 in a direction perpendicular or substantially perpendicular to the end surface R55 of the right connection portion R52. The shank portion of the bolt 56 is inserted in a through hole which passes through the left connection portion L52 in an axial direction of the bolt 56 (i.e., in a direction of a center line of the bolt 56). The nut 57 is attached to the shank portion of the bolt 56. The right connection portion R52 and the left connection portion L52 are sandwiched by and between the bolt 56 and the nut 57 in the axial direction of the bolt 56. Thus, the right connection portion R52 and the left connection portion L52 are connected together.

The right connection portion R52 and the left connection portion L52 are fastened by the bolt 56, and, in addition, are bonded together by an adhesive. The adhesive is applied to at least either one of the end surface R55 of the right connection portion R52 and the end surface L55 of the left connection portion L52 before connecting the right and left connection portions R52 and L52 together. An adhesive layer 58 that corresponds to a thin film of a dried adhesive is interposed between the end surface R55 of the right connection portion R52 and the end surface L55 of the left connection portion L52. The end surface R55 of the right connection portion R52 and the end surface L55 of the left connection portion L52 partially face each other with the adhesive layer 58 located between the end surface R55 and the end surface L55. Each of the right and left connection portions R52 and L52 is chemically or physically joined to the adhesive layer 58. Thus, the right connection portion R52 and the left connection portion L52 are connected to each other through the adhesive layer 58. A portion of a gap between the end surface R55 of the right connection portion R52 and the end surface L55 of the left connection portion L52 is filled up with the adhesive layer 58.

A region surrounded by a thick alternate long and two short dashed line in FIG. 14 represents an adhesive application range. In the example shown in FIG. 14, the application range is divided into two application ranges with the air intake ring 38 defining a boundary between the two application ranges in the front-rear direction. The front application range is continuous from a position P1 in front of the engine 10 to a position P2 above the engine 10. The rear application range is continuous from a position P3 above the engine 10 to a position P4 behind the engine 10. The position P3 is located at a more rearward position than the position P2. The adhesive layer 58 remains in the whole area of the application range. The adhesive layer 58 is disposed at any location along the right and left connection portions R52 and L52 in a plan view. Therefore, the right connection portion R52 and the left connection portion L52 are bonded together over a large range.

When the right divided cover R41 and the left divided cover L41 are connected together, the adhesive is applied to at least one of the end surface R55 of the right connection portion R52 and the end surface L55 of the left connection portion L52. Thereafter, before the adhesive is dried, the end surface R55 of the right connection portion R52 and the end surface L55 of the left connection portion L52 are fitted to each other, and the right connection portion R52 and the left connection portion L52 are fastened together by the bolt 56. Thus, the right divided cover R41 and the left divided cover L41 are connected together by the bolt 56 in a state in which the end surface R55 of the right connection portion R52 and the end surface L55 of the left connection portion L52 have been pressed against each other. When the adhesive is dried in this state, the adhesive interposed between the right connection portion R52 and the left connection portion L52 is changed into the adhesive layer 58, and the right connection portion R52 and the left connection portion L52 are bonded together.

As described above, a portion, which is positioned above the engine 10, of the engine cover 21 is divided into two pieces in the first preferred embodiment. In other words, the right divided cover R41 and the left divided cover L41, both of which directly face the engine 10, are disposed on the engine cover 21. This makes it possible to increase the degree of freedom of the shape of the engine cover 21. Additionally, the right and left connection portions R52 and L52 of the right and left divided covers R41 and L41 are disposed above the engine 10, and overlap the engine 10 in a plan view. Therefore, the right divided cover R41 and the left divided cover L41 are divided at a position which overlaps the engine 10 in a plan view. Therefore, it is possible to make a size difference between the right divided cover R41 and the left divided cover L41 smaller, and is possible to make restrictions, such as a shape restriction, imposed on the engine cover 21 smaller than when the right divided cover R41 and the left divided cover L41 are divided only at a position which does not overlap the engine 10 in a plan view.

In the present preferred embodiment, an interval between the right and left connection portions R52 and L52 of the right and left divided covers R41 and L41 is uniform at any location without changing depending on its location. If the interval between the right and left connection portions R52 and L52 is not uniform, there is a possibility that another cover to be interposed between the right and left connection portions R52 and L52 will be required. If the interval between the right and left connection portions R52 and L52 is uniform, it is possible to connect the right and left divided covers R41 and L41 together without such a cover interposed between the two connection portions.

In the present preferred embodiment, the adhesive layer 58 is interposed between the right connection portion R52 and the left connection portion L52. The adhesive layer 58 is a thin film of a dried adhesive, for example. Each of the right and left connection portions R52 and L52 is chemically or physically joined to the adhesive layer 58. Thus, the right connection portion R52 and the left connection portion L52 are connected together through the adhesive layer 58. Additionally, the adhesive layer 58 fills up a gap between the right connection portion R52 and the left connection portion L52. Therefore, it is possible to increase the sealability of the engine cover 21 in addition to enabling the right and left connection portions R52 and L52 to be connected together.

In the present preferred embodiment, the right connection portion R52 and the left connection portion L52 are bonded together in a large range. More specifically, the adhesive layer 58 interposed between the right and left connection portions R52 and L52 is disposed at any location of the right and left connection portions R52 and L52 in a plan view. Therefore, the range in which the adhesive comes into contact with the right and left connection portions R52 and L52 is wide, and the area of the adhesive layer 58 is large. This makes it possible to increase the adhesive strength of the right and left connection portions R52 and L52 and the sealability of the engine cover 21.

In the present preferred embodiment, the right and left housing portions R42 and L42 and the right and left flange portions R50 and L50 are disposed at the right and left divided covers R41 and L41. The right and left housing portions R42 and L42 directly face the engine 10, and the right and left flange portions R50 and L50 protrude outwardly from the right and left housing portions R42 and L42, respectively. It is possible to increase the rigidity of the right and left divided covers R41 and L41 by disposing the right and left flange portions R50 and L50 turned or bent back from the right and left housing portions R42 and L42, respectively. The right and left flange portions R50 and L50 included in the right and left connection portions R52 and L52 are bonded together by the adhesive layer 58. In other words, it is possible to enlarge a range in which an adhesive comes into contact with the right and left connection portions R52 and L52 by providing the right and left flange portions R50 and L50, and it is possible to increase the adhesive strength of the right and left connection portions R52 and L52.

In the present preferred embodiment, the right and left flange portions R50 and L50 are not disposed only at a specific position of the right and left connection portions R52 and L52, but the right and left flange portions R50 and L50 are disposed at any and all locations of the right and left connection portions R52 and L52. This makes it possible to enlarge a range in which an adhesive comes into contact with the right and left connection portions R52 and L52, and makes it possible to increase the adhesive strength of the right and left connection portions R52 and L52. Therefore, it is possible to prevent the right and left divided covers R41 and L41 from being separated at the right and left connection portions R52 and L52, respectively. Additionally, the adhesive application range is enlarged, and the area of the adhesive layer 58 is widened, and therefore it is possible to make the sealability of the engine cover 21 even higher.

In the present preferred embodiment, the right and left connection portions R52 and L52 are fastened together by the bolt 56 in addition to bonding the right and left connection portions R52 and L52 together by an adhesive. This makes it possible to increase the connection strength of the right and left connection portions R52 and L52. Additionally, when the right and left connection portions R52 and L52 are fastened together by the bolt 56, the right and left divided covers R41 and L41 are fixed before the adhesive is dried. Therefore, the right and left divided covers R41 and L41 are not required to be stationary until the adhesive becomes dry, or are not required to be fixed by a jig until the adhesive becomes dry. Additionally, when the right and left connection portions R52 and L52 are fastened together by the bolt 56, the right and left divided covers R41 and L41 are fixed in an appropriate positional relationship, and therefore it is possible to prevent the right and left divided covers R41 and L41 from being bonded together in a deviated state.

In the present preferred embodiment, the cylindrical air intake ring 38 through which air to be supplied to the engine 10 passes is disposed at the right and left divided covers R41 and L41. The air intake ring 38 is divided into the right band portion R46 and the left band portion L46. Both ends of the right and left band portions R46 and L46 define a portion of the right and left connection portions R52 and L52. Therefore, the right and left divided covers R41 and L41 are divided at a position passing through the air intake ring 38. The air intake ring 38 is ordinarily disposed at a center of the engine 10 or at a position near this center in a plan view. Therefore, it is possible to reduce a size difference between the right divided cover R41 and the left divided cover L41 by dividing the right and left divided covers R41 and L41 at the position passing through the air intake ring 38.

In the present preferred embodiment, the right and left divided covers R41 and L41 are divided not only above the engine 10 but also in front of and behind the engine 10. The right and left connection portions R52 and L52 extend from the front of the engine 10 to the rear of the engine 10 through a space above the engine 10. Therefore, the right and left divided covers R41 and L41 are divided rightwardly and leftwardly. The engine cover 21 for the outboard motor 3 ordinarily has a substantially lateral symmetrical shape. Therefore, it is possible to reduce a size difference between the right divided cover R41 and the left divided cover L41 by dividing the right divided cover R41 and the left divided cover L41 rightwardly and leftwardly.

In the present preferred embodiment, the right and left divided covers R41 and L41 are divided with the division line DL defining a boundary between these covers R41 and L41. The division line DL halves or substantially halves the right and left divided covers R41 and L41 rightwardly and leftwardly in a plan view. More specifically, the division line DL passes through a position at which a distance from a right end of the right and left divided covers R41 and L41 to the division line DL is equal or substantially equal to a distance from a left end of the right and left divided covers R41 and L41 to the division line DL in a plan view. This makes it possible to equalize or substantially equalize the size of the right divided cover R41 and the size of the left divided cover L41 with each other.

In the present preferred embodiment, at least a portion of the outline 10*o* of the engine 10 in a plan view overlaps the right and left divided covers R41 and L41 in a plan view. Therefore, the right and left divided covers R41 and L41 have a size in which at least a portion of the outline of the right and left divided covers R41 and L41 in a plan view is disposed outside the outline 10*o* of the engine 10 in a plan view. This large-sized engine cover 21 is divided, and therefore it is possible to reduce restrictions, such as a shape restriction, imposed on the engine cover 21.

In the present preferred embodiment, the right connection portion R52 and the left connection portion L52 are protected by the exterior panel 33 of the top panel 33*t*, etc. The exterior panel 33 is disposed outside the right and left divided covers R41 and L41. When the right and left connection portions R52 and L52 are seen from outside the right and left divided covers R41 and L41, the exterior panel 33 overlaps at least a portion of the right and left connection portions R52 and L52, and at least a portion of the right and left connection portions R52 and L52 is concealed by the exterior panel 33. Mist or spray collides with the exterior panel 33 before reaching the right and left connection portions R52 and L52. Therefore, it is possible to reduce water that passes through a space between the right and left connection portions R52 and L52 and then enters into the engine cover 21, and it is possible to increase the waterproofness of the engine cover 21. Additionally, when the right and left connection portions R52 and L52 are concealed by the exterior panel 33, water pressure is not directly applied to the boundary between the right and left connection portions R52 and L52, and therefore it is possible to increase the robustness of the right and left connection portions R52 and L52.

Next, a second preferred embodiment will be described.

Figure 15:
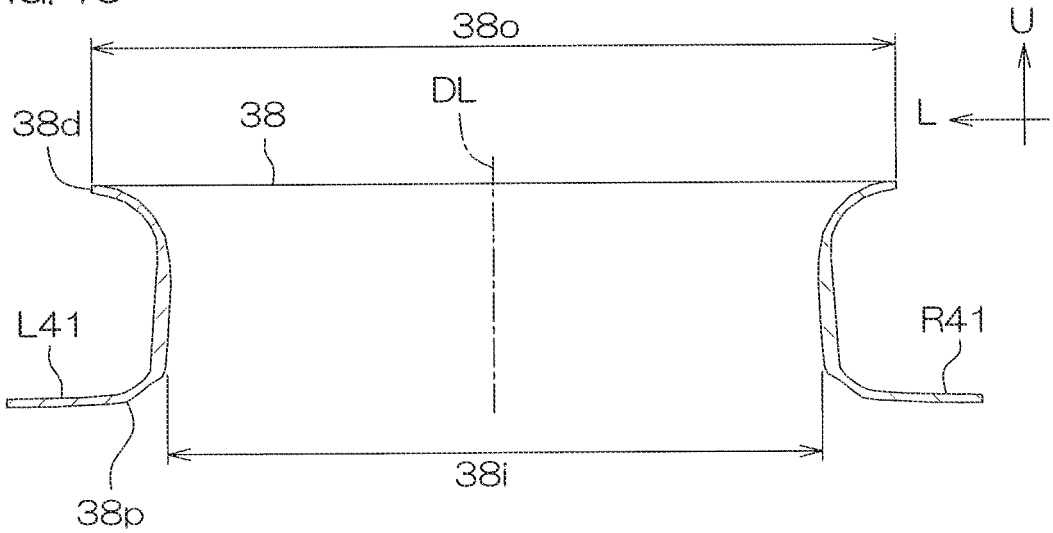
FIG. 15 is a cross-sectional view of an air intake ring according to a second preferred embodiment of the present invention.

FIG. 15 is a cross-sectional view of the air intake ring 38 according to the second preferred embodiment of the present invention. FIG. 15 shows a cross section of the air intake ring 38 along a plane including the center line of the air intake ring 38. In FIG. 15, the same reference sign as in FIG. 1 or the like is given to a constituent equivalent to each constituent shown above in FIG. 1 to FIG. 14, and a description of such an equivalent constituent is omitted.

At least either one of an inner diameter 38*i* and an outer diameter 38*o* of the air intake ring 38 is not necessarily required to be uniform from the base end 38*p* of the air intake ring 38 to the front end 38*d* of the air intake ring 38. In other words, at least either one of the inner diameter 38*i* and the outer diameter 38*o* of the air intake ring 38 may be continuously or stepwisely changed. FIG. 15 shows an example in which both the inner diameter 38*i* and the outer diameter 38*o* of the air intake ring 38 continuously change.

In the example shown in FIG. 15, the inner diameter 38*i* and the outer diameter 38*o* of the air intake ring 38 become continuously smaller as the air intake ring 38 approaches the front end 38*d* of the air intake ring 38, and thereafter become continuously larger as the air intake ring 38 approaches the front end 38*d* of the air intake ring 38. The inner diameter 38*i* and the outer diameter 38*o* of the air intake ring 38 are the largest at the front end 38*d* of the air intake ring 38. The inner diameter 38*i* and the outer diameter 38*o* of the air intake ring 38 are the smallest at a position between the front end 38*d* of the air intake ring 38 and the base end 38*p* of the air intake ring 38. The maximum value of the inner diameter 38*i* of the air intake ring 38 is smaller than the maximum value of the outer diameter 38*o* of the air intake ring 38, and is larger than the minimum value of the outer diameter 38*o* of the air intake ring 38.

The maximum value of the inner diameter 38*i* and the maximum value of the outer diameter 38*o* of the air intake ring 38, i.e., the inner diameter 38*i* and the outer diameter 38*o* of the air intake ring 38 at the front end 38*d* of the air intake ring 38 are larger than the inner diameter 38*i* and the outer diameter 38*o* of the air intake ring 38 at the base end 38*p* of the air intake ring 38. The front end 38*d* of the air intake ring 38 is located at a more outward position than the base end 38*p* of the air intake ring 38 with respect to the radial direction of the air intake ring 38. In other words, the front end 38*d* of the air intake ring 38 overhangs the base end 38*p* of the air intake ring 38, and an outer peripheral surface of the air intake ring 38 faces an outer surface of the main cover 34 in an axial direction of the air intake ring 38 (i.e., in a direction of a center line of the air intake ring 38). When viewed in the axial direction of the air intake ring 38, the front end 38*d* of the air intake ring 38 overlaps the main cover 34.

In the second preferred embodiment, it is possible to fulfill the following effects in addition to the effects according to the first preferred embodiment. More specifically, in the second preferred embodiment, the diameter of the outer peripheral surface of the air intake ring 38 stepwisely or continuously becomes larger as the air intake ring 38 approaches the front end 38*d* of the air intake ring 38. Therefore, it is difficult for water to enter into the air intake ring 38 from the front end 38*d* of the air intake ring 38 while flowing or splashing along the outer peripheral surface of the air intake ring 38. If the air intake ring 38 is a single integral and unitary member, there is a possibility that the air intake ring 38 cannot have the above structure depending on the manufacturing method of or the material of the air intake ring 38. If the air intake ring 38 is divided into the right band portion R46 and the left band portion L46, the air intake ring 38 is able to be arranged in the above way.

In the present preferred embodiment, the diameter of the inner peripheral surface of the air intake ring 38 continuously becomes larger as the air intake ring 38 approaches the front end 38*d* of the air intake ring 38. Therefore, it is possible to reduce resistance applied to air drawn through an entrance defined by the front end 38*d* of the air intake ring 38 into the air intake ring 38. This makes it possible to reduce the pressure loss of intake air, and makes it possible to improve the output of the engine 10. It is possible to weaken negative pressure inside the engine cover 21 by reducing the pressure loss of intake air in the air intake ring 38, and it is possible to reduce water entering into the engine cover 21 from a joint of the engine cover 21. Additionally, the maximum value of the inner diameter 38*i* of the air intake ring 38 is larger than the minimum value of the outer diameter 38*o* of the air intake ring 38, and therefore the outer diameter 38*o* of the air intake ring 38 stepwisely or continuously becomes larger as the air intake ring 38 approaches the front end 38*d* of the air intake ring 38. Therefore, it is difficult for water to enter into the air intake ring 38 from the front end 38*d* of the air intake ring 38 while flowing or splashing along the outer peripheral surface of the air intake ring 38.

When a tapered ring whose inner and outer diameters continuously become larger as they recede from the front end 38*d* of the air intake ring 38 is attached to the front end 38*d* of the air intake ring 38, a level difference whose cross section has the shape of the letter L is formed at a joint between the ring and the air intake ring 38. In this case, in addition to a need to add a tapered ring, air intake efficiency becomes smaller than in a case in which there is no level difference. The inner diameter 38*i* of the air intake ring 38 is continuously changed, and therefore the inner peripheral surface of the air intake ring 38 does not have such a level difference. Therefore, it is possible to make the air intake efficiency higher than in a case in which a tapered ring is added.

Although preferred embodiments of the present invention have been described above, the present invention is not restricted to the contents of these preferred embodiments and various modifications are possible within the scope of the present invention.

For example, the right connection portion R52 of the right divided cover R41 and the left connection portion L52 of the left divided cover L41 may not be brought into direct contact with each other, but a seal made of rubber or resin that is lower in strength than the right and left connection portions R52 and L52 may be interposed between the right and left connection portions R52 and L52.

An interval between the right connection portion R52 and the left connection portion L52 may be changed. In this case, another cover that is equal in strength to or that is substantially equal in strength to the right and left divided covers R41 and L41 may be interposed between the right connection portion R52 and the left connection portion L52.

The right connection portion R52 and the left connection portion L52 may be partially bonded together. In other words, the adhesive layer 58 may be disposed not in the whole area of the right and left connection portions R52 and L52 in a plan view but only in a portion of the right and left connection portions R52 and L52 in a plan view.

The right connection portion R52 and the left connection portion L52 may be connected together only by fastening both of the connection portions together by use of the bolt 56 or only by bonding both of the connection portions together by use of an adhesive, or the right connection portion R52 and the left connection portion L52 may be connected together according to methods other than fastening and bonding.

The right flange portion R50 may be disposed not at the entirety of the lateral end surface R43 of the right housing portion R42 but only at a portion of the lateral end surface R43 of the right housing portion R42. Likewise, the left flange portion L50 may be disposed not at the entirety of the lateral end surface L43 of the left housing portion L42 but only at a portion of the lateral end surface L43 of the left housing portion L42. Alternatively, the right and left flange portions R50 and L50 may be omitted from the right and left divided covers R41 and L41. In this case, it suffices to bond the right and left housing portions R42 and L42 together by use of an adhesive.

Only the housing 35 of the main cover 34 may be divided without dividing the air intake ring 38 of the main cover 34. In other words, the division line DL representing a boundary between the right divided cover R41 and the left divided cover L41 may be not necessarily required to pass through the air intake ring 38 in a plan view. The air intake ring 38 may be omitted from the main cover 34.

The main cover 34 may be divided not at a position at which the main cover 34 is halved rightwardly and leftwardly but at a position deviated rightwardly or leftwardly. The main cover 34 may be divided not in the right-left direction but in the front-rear direction. In other words, the division line DL may extend from a rightward position of the main cover 34 to a leftward position of the main cover 34 in a plan view. In this case, the division line DL may be a vertical plane perpendicular or substantially perpendicular to the front-rear direction.

The outline 34*o* of the main cover 34 in a plan view may overlap the engine 10 in a plan view, instead of surrounding the engine 10 over the whole circumference of the engine 10. In other words, a portion of the engine 10 may be disposed outside the outline 34*o* of the main cover 34 in a plan view.

If at least a portion of the main cover 34 overlaps the engine 10 in a plan view, the main cover 34 may be smaller than the engine 10 in a plan view. In this case, the outline 10*o* of the engine 10 in a plan view may surround the main cover 34 over the whole circumference of the main cover 34, or may overlap the main cover 34 in a plan view. In the former case, the main cover 34 is divided only at a position overlapping the engine 10 in a plan view.

If the right and left divided covers R41 and L41 overlap the engine 10 when the main cover 34 is vertically seen from above the main cover 34, at least either one of the right and left divided covers R41 and L41 is not necessarily required to overlap the engine 10 when the main cover 34 is horizontally seen. In other words, the peripheral wall 37 of the cylindrical housing 35 surrounding the engine 10 over the whole circumference of the engine 10 may be omitted from the right and left housing portions R42 and L42.

Not the entirety of the right and left connection portions R52 and L52 but only a portion of the right and left connection portions R52 and L52 may be covered with the exterior panel 33, such as the top panel 33*t*. The entirety of the right and left connection portions R52 and L52 may be exposed from the exterior panel 33. At least one among the top panel 33*t*, the front panel 33*f*, the rear panel 33*r*, the right panel 33R, and the left panel 33L may be omitted.

Two or more of all the arrangements mentioned above may be combined together.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An engine cover for an outboard motor that houses an engine, the engine cover comprising:

two divided covers disposed above and directly facing the engine; wherein the two divided covers include two connections that are connected to each other and overlap the engine in a plan view;

the two divided covers include two bands that define a cylindrical air intake ring through which air to be supplied to the engine passes;

the two bands are fitted to each other at each end of the two bands;

the two connections include each end of the two bands; and an outer diameter of the air intake ring becomes larger as the air intake ring extends toward a front end of the air intake ring.

2. The engine cover according to claim 1, wherein an inner diameter of the air intake ring continuously or stepwisely becomes larger as the air intake ring extends toward the front end of the air intake ring; and a maximum value of the inner diameter of the air intake ring is larger than a minimum value of the outer diameter of the air intake ring.

* * * * *